US009953527B1

(12) United States Patent
Alhazmi

(10) Patent No.: US 9,953,527 B1
(45) Date of Patent: Apr. 24, 2018

(54) INTERSECTION COMMUNICATION SYSTEMS AND METHODS

(71) Applicant: Rayan Alhazmi, McLean, VA (US)

(72) Inventor: Rayan Alhazmi, McLean, VA (US)

( * ) Notice: Subject to any disclaimer, the term of this patent is extended or adjusted under 35 U.S.C. 154(b) by 0 days.

(21) Appl. No.: 15/437,936

(22) Filed: Feb. 21, 2017

(51) Int. Cl.
*G08G 1/087* (2006.01)
*G08G 1/08* (2006.01)
*G08G 1/005* (2006.01)

(52) U.S. Cl.
CPC ..... *G08G 1/08* (2013.01); *G08G 1/005* (2013.01)

(58) Field of Classification Search
CPC ..... G08G 1/08; G08G 1/081; G08G 1/082; G08G 1/083; G08G 1/085; G08G 1/087; G08G 1/002; G08G 1/005; G08G 1/007; G08G 1/008; G08G 1/095; G08G 1/164; E01C 1/02; E01C 17/00; E01F 9/553
USPC .... 340/907, 917, 944, 932, 906, 929; 404/9; 701/301
See application file for complete search history.

(56) References Cited

U.S. PATENT DOCUMENTS 4,408,180 A * 10/1983 Metz ..... G08G 1/095 340/907
7,317,406 B2 * 1/2008 Wolterman ..... G08G 1/08 340/905
7,551,104 B2 6/2009 Meng
8,395,530 B2 * 3/2013 Al-Hasan ..... G08G 1/095 340/901
8,760,315 B2 * 6/2014 Williamson ..... G08G 1/087 340/906
2002/0008637 A1 * 1/2002 Lemelson ..... G08G 1/07 340/907
2005/0008434 A1 * 1/2005 Chen ..... E01F 9/553 404/16
2005/0104747 A1 * 5/2005 Silic ..... G08G 1/005 340/944
2005/0270175 A1 12/2005 Peddie et al.
(Continued)

OTHER PUBLICATIONS

Cornelia Hebenstreit, et al., "Deliverable 2.2—Policy Definition and dynamic Policy Selection Algorithms", Colombo, http://elib.dlr.de/96128/1/COLOMBO_D2.2_PolicySelectionDefinition_v1.9.pdf, Version 1.8, Mar. 31, 2014, pp. 1-186.

*Primary Examiner* — George Bugg
*Assistant Examiner* — Munear Akki
(74) *Attorney, Agent, or Firm* — Oblon, McClelland, Maier & Neustadt, L.L.P.

(57) ABSTRACT

An intersection communications system includes a vehicle intersection traffic movement indicator; a traffic movement surface indicator positioned behind an edge of the vehicle traffic intersection; a pedestrian lane surface indicator; one or more traffic direction surface indicators positioned within the vehicle traffic intersection; and a communications server configured to transmit a first signal to a first traffic movement surface indicator when a first monitored event occurs, transmit a second signal to a first right-turn traffic direction surface indicator directing the first vehicle to turn right from a first street to a second street when a second monitored event occurs, transmit a third signal to a second left-turn traffic direction surface indicator directing the first vehicle to turn left from the first street to the second street when a third monitored event occurs, and transmit a fourth signal to the pedestrian lane surface indicator when a fourth monitored event occurs.

20 Claims, 15 Drawing Sheets

(56) References Cited

U.S. PATENT DOCUMENTS

| | | | | |
|---|---|---|---|---|
| 2006/0181433 | A1* | 8/2006 | Wolterman | G08G 1/08 340/917 |
| 2007/0296610 | A1* | 12/2007 | Heffernan | G08G 1/095 340/932 |
| 2009/0009362 | A1* | 1/2009 | Miller | H05B 33/0803 340/907 |
| 2011/0109478 | A1* | 5/2011 | Williamson | G08G 1/087 340/906 |
| 2014/0097969 | A1* | 4/2014 | Ni | G08G 1/07 340/907 |
| 2014/0368358 | A1 | 12/2014 | Xie et al. | |
| 2016/0063859 | A1* | 3/2016 | Leung | E01C 1/002 404/1 |
| 2016/0267790 | A1 | 9/2016 | Raamot | |

* cited by examiner

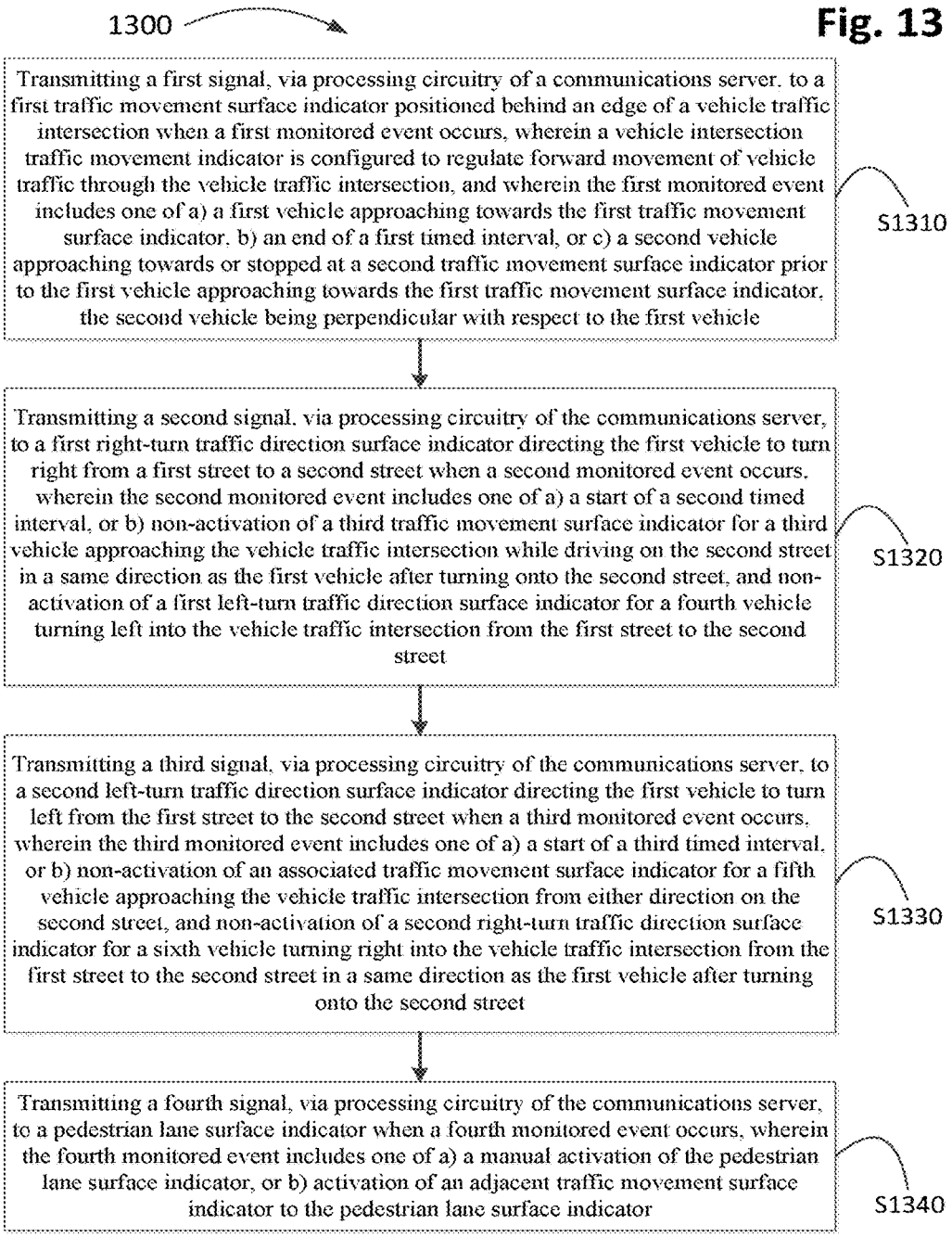
1300
Fig. 13
Transmitting a first signal, via processing circuitry of a communications server, to a first traffic movement surface indicator positioned behind an edge of a vehicle traffic intersection when a first monitored event occurs, wherein a vehicle intersection traffic movement indicator is configured to regulate forward movement of vehicle traffic through the vehicle traffic intersection, and wherein the first monitored event includes one of a) a first vehicle approaching towards the first traffic movement surface indicator, b) an end of a first timed interval, or c) a second vehicle approaching towards or stopped at a second traffic movement surface indicator prior to the first vehicle approaching towards the first traffic movement surface indicator, the second vehicle being perpendicular with respect to the first vehicle
S1310
Transmitting a second signal, via processing circuitry of the communications server, to a first right-turn traffic direction surface indicator directing the first vehicle to turn right from a first street to a second street when a second monitored event occurs, wherein the second monitored event includes one of a) a start of a second timed interval, or b) non-activation of a third traffic movement surface indicator for a third vehicle approaching the vehicle traffic intersection while driving on the second street in a same direction as the first vehicle after turning onto the second street, and non-activation of a first left-turn traffic direction surface indicator for a fourth vehicle turning left into the vehicle traffic intersection from the first street to the second street
S1320
Transmitting a third signal, via processing circuitry of the communications server, to a second left-turn traffic direction surface indicator directing the first vehicle to turn left from the first street to the second street when a third monitored event occurs, wherein the third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first vehicle after turning onto the second street
S1330
Transmitting a fourth signal, via processing circuitry of the communications server, to a pedestrian lane surface indicator when a fourth monitored event occurs, wherein the fourth monitored event includes one of a) a manual activation of the pedestrian lane surface indicator, or b) activation of an adjacent traffic movement surface indicator to the pedestrian lane surface indicator
S1340

INTERSECTION COMMUNICATION SYSTEMS AND METHODS

GRANT OF NON-EXCLUSIVE RIGHT

This application was prepared with financial support from the Saudi Arabian Cultural Mission, and in consideration therefore the present inventor(s) has granted The Kingdom of Saudi Arabia a non-exclusive right to practice the present invention in the United States.

BACKGROUND

A vehicle traffic intersection involves multi-directional flow of numerous vehicles, as well as numerous pedestrians in urban and suburban areas. A driver's attention is required to focus on many activities simultaneously, ranging from the current state of a traffic signal, vehicles turning into the driver's path, vehicles changing lanes into the driver's path, and pedestrians attempting to cross a street in front of the driver's path.

Traffic signs, signals, and pavement markings attempt to provide safe and smooth vehicle travel through a vehicle traffic intersection. However, many traffic accidents still occur at vehicle traffic intersections. Some of the pavement markings are difficult to see until the driver is very close to the markings. Pavement markings also become faded with time. In addition, pavement markings can be difficult to see during low visibility times, such as periods of rain, snow, and fog, as well as nighttime periods.

The "background" description provided herein is for the purpose of generally presenting the context of the disclosure. Work of the presently named inventors, to the extent it is described in this background section, as well as aspects of the description which may not otherwise qualify as conventional at the time of filing, are neither expressly nor impliedly admitted as conventional against the present disclosure.

SUMMARY

One embodiment includes an intersection communications system includes a vehicle intersection traffic movement indicator configured to regulate forward movement of a vehicle through a vehicle traffic intersection and positioned within or adjacent to the vehicle traffic intersection; a traffic movement surface indicator positioned behind an edge of the vehicle traffic intersection; a pedestrian lane surface indicator positioned adjacent to the edge of the vehicle traffic intersection; one or more traffic direction surface indicators positioned within the vehicle traffic intersection; and a communications server having processing circuitry. The processing circuitry is configured to transmit a first signal to a first traffic movement surface indicator when a first monitored event occurs, wherein the first monitored event includes one of a) a first vehicle approaching towards the first traffic movement surface indicator, b) an end of a first timed interval, or c) a second vehicle approaching towards or stopped at a second traffic movement surface indicator prior to the first vehicle approaching towards the first traffic movement surface indicator, the second vehicle being perpendicular with respect to the first vehicle; transmit a second signal to a first right-turn traffic direction surface indicator directing the first vehicle to turn right from a first street to a second street when a second monitored event occurs, wherein the second monitored event includes one of a) a start of a second timed interval, or b) non-activation of a third traffic movement surface indicator for a third vehicle approaching the vehicle traffic intersection while driving on the second street in a same direction as the first vehicle after turning onto the second street, and non-activation of a first left-turn traffic direction surface indicator for a fourth vehicle turning left into the vehicle traffic intersection from the first street to the second street; transmit a third signal to a second left-turn traffic direction surface indicator directing the first vehicle to turn left from the first street to the second street when a third monitored event occurs, wherein the third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first vehicle after turning onto the second street; and transmit a fourth signal to the pedestrian lane surface indicator when a fourth monitored event occurs, wherein the fourth monitored event includes one of a) a manual activation of the pedestrian lane surface indicator, or b) activation of an adjacent traffic movement surface indicator to the pedestrian lane surface indicator.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 13 is a flowchart for an exemplary traffic movement method according to one embodiment.

DETAILED DESCRIPTION

The following descriptions are meant to further clarify the present disclosure by giving specific examples and embodiments of the disclosure. These embodiments are meant to be illustrative rather than exhaustive. The full scope of the disclosure is not limited to any particular embodiment disclosed in this specification, but rather is defined by the claims.

In the interest of clarity, not all of the features of the implementations described herein are shown and described in detail. It will be appreciated that in the development of any such actual implementation, numerous implementation-specific decisions need to be made in order to achieve the developer's specific goals, such as compliance with application- and business-related constraints, and that these specific goals will vary from one implementation to another and from one developer to another.

Embodiments herein describe communication systems and methods for traffic movement and in particular, traffic movement through vehicle traffic intersections. A combination of sensors and processing circuitry of a communications server monitor and direct vehicles through a vehicle traffic intersection. Embodiments herein also provide monitored and directed traffic flow for driverless vehicles through a vehicle traffic intersection.

Figure 1:
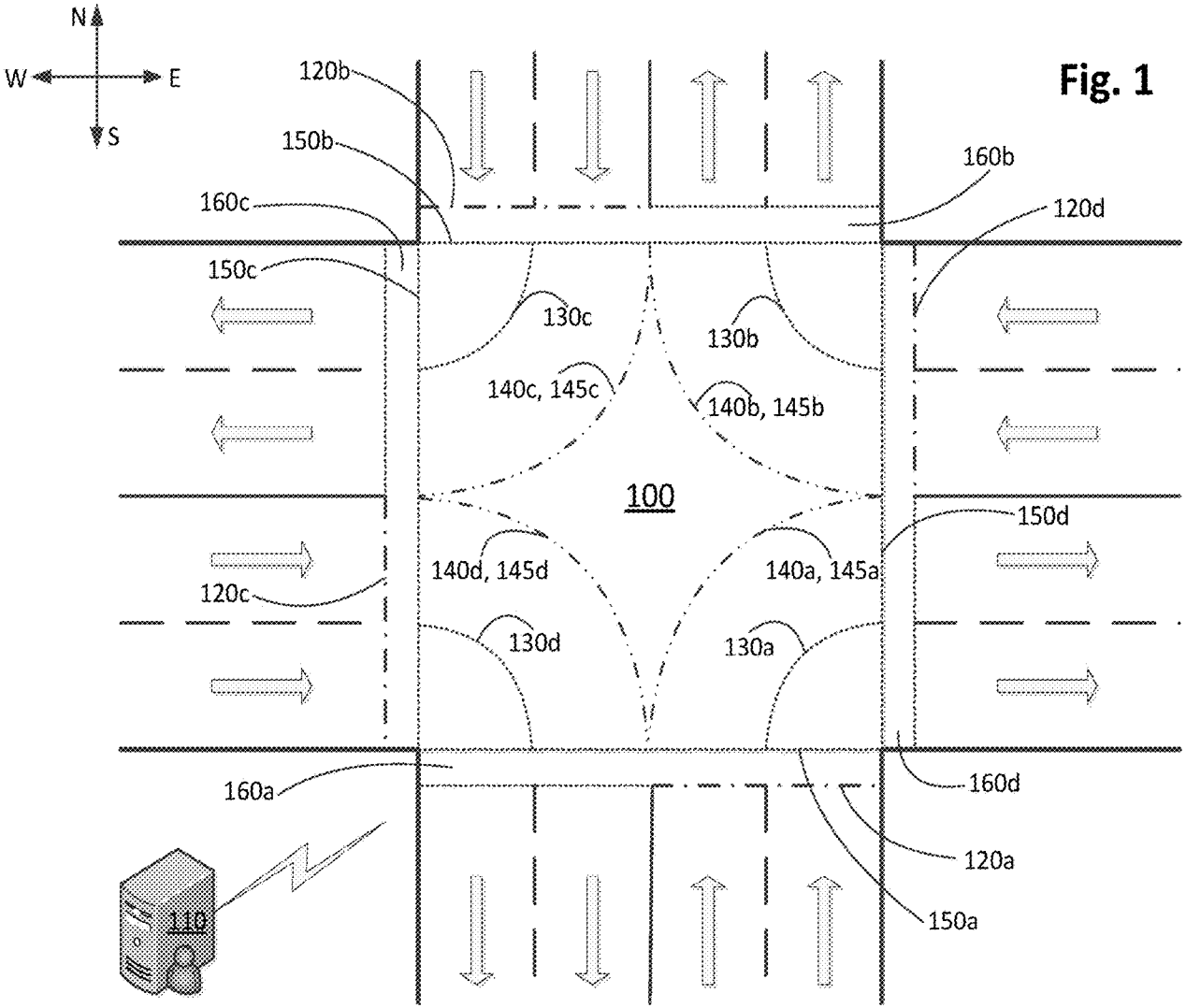
FIG. 1 is a block diagram illustrating an exemplary vehicle traffic intersection according to one embodiment.

FIG. 1 is a block diagram illustrating an exemplary vehicle traffic intersection 100 for a four-direction intersection in which two lanes are present in each of the four directions. Several road surface indicators are illustrated in and around the vehicle traffic intersection 100, which represent traffic movement surface indicators 120, right-turn traffic direction surface indicators 130, left-turn traffic direction surface indicators 140, dual-purpose traffic direction surface indicators 145, and pedestrian lane surface indicators 150.

Each road surface indicator includes a series of interconnected lights, such as light-emitting diodes (LEDs). Illumination of the interconnected lights is controlled, via processing circuitry of a communications server 110. The communications server 110 transmits various signals to each of the road surface indicators in response to environmental feedback data collected from a plurality of sensors, timers, and/or signals associated with the vehicle traffic intersection 100.

One or more vehicle intersection traffic movement indicators are positioned within or adjacent to the vehicle traffic intersection 100. An example of a vehicle intersection traffic movement indicator is a traffic signal. The communications server 110 works in conjunction with each traffic signal of the vehicle traffic intersection 100 to transmit signals to one or more road surface indicators for safe traffic travel in each direction through the vehicle traffic intersection 100.

Traffic movement surface indicators 120 are illustrated in a setback position from each edge of the vehicle traffic intersection 100. A south traffic movement surface indicator 120*a*, a north traffic movement surface indicator 120*b*, a west traffic movement surface indicator 120*c*, and an east traffic movement surface indicator 120*d* are illustrated in FIG. 1. The lights in each of the traffic movement surface indicators 120 can be a standard neutral color or the lights can be red (or other stop movement color) to further alert a driver to stop movement at an activated traffic movement surface indicator 120. In addition, the lights of the traffic movement surface indicator 120 can flash on and off during activation.

The communications server 110 transmits a signal to illuminate a respective traffic movement surface indicator 120 to alert a driver of an approaching vehicle to stop movement into the vehicle traffic intersection 100. For example, when a vehicle is approaching the vehicle traffic intersection 100 from the south, the south traffic movement surface indicator 120*a* is illuminated, via the communications server 110, to alert the driver to stop movement before entering the vehicle traffic intersection 100. In an embodiment, the communications server 100 transmits a signal to the south traffic movement surface indicator 120*a* in response to a stop movement signal from a traffic signal associated with the south traffic movement surface indicator 120*a*. When the traffic signal has changed to a resume movement signal, the south traffic movement surface indicator 120*a* discontinues illumination, via a signal from the communications server 110.

Likewise, when the north traffic movement surface indicator 120*b* is illuminated in response to a changed or changing traffic signal, a vehicle approaching the vehicle traffic intersection 100 from the north is alerted to stop movement before entering the vehicle traffic intersection 100. When the west traffic movement surface indicator 120*c* is illuminated in response to a changed or changing traffic signal, a vehicle approaching the vehicle traffic intersection 100 from the west is alerted to stop movement before entering the vehicle traffic intersection 100. When the east traffic movement surface indicator 120*d* is illuminated in response to a changed or changing traffic signal, a vehicle approaching the vehicle traffic intersection 100 from the east is alerted to stop movement before entering the vehicle traffic intersection 100.

In the embodiment described above, illumination of the traffic movement surface indicators 120 is recognized by a driver of the respective vehicle and there from, the driver stops the vehicle before entering the vehicle traffic intersection 100. In another embodiment, driverless vehicles are programmed in conjunction with the communications server 110 and execute instructions accordingly. Therefore, when a traffic movement surface indicator 120 in the path of an oncoming driverless vehicle is illuminated, the oncoming driverless vehicle receives a signal from the communications server 110 to stop movement of the driverless vehicle upon reaching the illuminated traffic movement surface indicator 120. The driverless vehicle remains stopped until illumination of the associated traffic movement surface indicator 120 has subsided and the driverless vehicle receives a signal from the communications server 110 to continue movement through the vehicle traffic intersection 100.

FIG. 1 also illustrates a plurality of right-turn traffic direction surface indicators 130. A southeast right-turn traffic direction surface indicator 130*a* is illuminated, via the communications server 110 when the communications server 110 has determined it is safe for a northbound vehicle located at the southeast corner of the vehicle traffic intersection 100 to turn right into an adjacent lane of an eastbound street.

Likewise, a northeast right-turn traffic direction surface indicator 130*b* is illuminated, via the communications server 110 when the communications server 110 has determined it is safe for a westbound vehicle located at the northeast corner of the vehicle traffic intersection 100 to turn right into an adjacent lane of a northbound street. A northwest right-turn traffic direction surface indicator 130*c* is illuminated, via the communications server 110 when the communications server 110 has determined it is safe for a southbound vehicle located at the northwest corner of the vehicle traffic intersection 100 to turn right into an adjacent lane of a westbound street. A southwest right-turn traffic direction surface indicator 130*d* is illuminated, via the communications server 110 when the communications server 110 has determined it is safe for an eastbound vehicle located at the southwest corner of the vehicle traffic intersection 100 to turn right into an adjacent lane of a southbound street.

The lights of a right-turn traffic direction surface indicator 130 can be neutral in color or the lights can be green (or other forward movement color) to alert a driver of an intended forward direction. In addition, the lights can be flashing or streaming to further accentuate the intended vehicle path.

In the embodiment described above, illumination of the right-turn traffic direction surface indicators 130 is recognized by a driver of the respective vehicle and there from, the driver makes the associated right turn from a first street through the vehicle traffic intersection 100 onto a second street. In another embodiment, driverless vehicles are programmed in conjunction with the communications server 110 and execute instructions accordingly. Therefore, when a right-turn traffic direction surface indicator 130 is illuminated, an oncoming driverless vehicle driving on the first street receives a signal from the communications server 110 to turn right into an adjacent lane of the second street.

FIG. 1 also illustrates a plurality of left-turn traffic direction surface indicators 140. A southeast left-turn traffic direction surface indicator 140*a* is illuminated, via the communications server 110 when the communications server 110 has determined it is safe for the westbound vehicle located at the northeast corner of the vehicle traffic intersection 100 to turn left into an adjacent lane of the southbound street.

Likewise, a northeast left-turn traffic direction surface indicator 140*b* is illuminated, via the communications server 110 when the communications server 110 has determined it is safe for a southbound vehicle located at the northwest corner of the vehicle traffic intersection 100 to turn left into an adjacent lane of the eastbound street. A northwest left-turn traffic direction surface indicator 140*c* is illuminated, via the communications server 110 when the communications server 110 has determined it is safe for the eastbound vehicle located at the southwest corner of the vehicle traffic intersection 100 to turn left into an adjacent lane of the northbound street. A southwest left-turn traffic direction surface indicator 140*d* is illuminated, via the communications server 110 when the communications server 110 has determined it is safe for the northbound vehicle located at the southeast corner of the vehicle traffic intersection 100 to turn left into an adjacent lane of the westbound street.

The lights of a left-turn traffic direction surface indicator 140 can be neutral in color or the lights can be green (or other forward movement color) to alert a driver of an intended forward direction. In addition, the lights can be flashing or streaming to further accentuate the intended vehicle path.

In the embodiment described above, illumination of the left-turn traffic direction surface indicators 140 is recognized by a driver of the respective vehicle and there from, the driver makes the associated left turn from a first street through the vehicle traffic intersection 100 onto a second street. In another embodiment, driverless vehicles are programmed in conjunction with the communications server 110 and execute instructions accordingly. Therefore, when a left-turn traffic direction surface indicator 140 is illuminated, an oncoming driverless vehicle driving on the first street receives a signal from the communications server 110 to turn left into an adjacent lane of the second street.

In an embodiment, a left-turn traffic direction surface indicator 140 can be used as a dual-purpose traffic direction surface indicator 145. The left-turn traffic direction surface indicator 140 used for directing a first vehicle turning from a first street through the vehicle traffic intersection 100 onto a second street could also be used as a second right-turn traffic direction surface indicator for a second vehicle turning from the second street through the vehicle traffic intersection 100 onto the first street. For example, the southwest left-turn traffic direction surface indicator 140*d* directs a first vehicle turning from the northbound street through the vehicle traffic intersection 100 onto the westbound street. In addition, the southwest left-turn traffic direction surface indicator 140*d* could be used as a second right-turn traffic direction surface indicator 145*d* for a second vehicle sitting in the left lane of the eastbound street to turn right into the left lane of the southbound street.

Dual-purpose traffic direction surface indicators 145 as described herein can have the lights of the surface indicator configured such that the light illumination is directed towards the intended oncoming traffic. For example, when the southwest left-turn traffic surface indicator 140*d* is intended to forward traffic from the northbound street onto the westbound street, only the vehicle(s) sitting in the left lane of the northbound street at the southeast corner of the vehicle traffic intersection 100 can see the illuminated lights of the surface indicator. Likewise, when the second right-turn traffic direction surface indicator 145*d* is intended to forward traffic from the left lane of the eastbound street into the left lane of the southbound street, only the vehicle(s) sitting in the left lane of the eastbound street at the southwest corner of the vehicle traffic intersection 100 can see the illuminated lights of the surface indicator. In an alternative embodiment, the indicator lights can illuminate green light (or other color of light to indicate forward movement) towards the intended movement traffic and illuminate red light (or other color of light to indicate a stop in forward movement) towards the intended stopped traffic.

If traffic movement is simultaneously directed by the communications server 110 for both paths of traffic flow at a particular dual-purpose traffic direction surface indicator 145, the indicator lights are simultaneously illuminated towards the intended movement traffic of both streets. When multiple colors of illuminated light are used by the dual-purpose traffic direction surface indicator 145, green light (or any other color designated as a forward traffic movement indicator) is illuminated towards both streets of intended movement traffic. Likewise, red light (or any other color designated as a stopped traffic movement indicator) is illuminated towards both streets of intended stopped traffic when the communications server 110 has determined that traffic should not proceed in either left turn or right turn direction.

FIG. 1 also illustrates a plurality of pedestrian movement surface indicators 150. A south pedestrian movement surface indicator 150*a* is adjacent to the south side of the vehicle traffic intersection 100 and parallel to the south traffic movement surface indicator 120*a*. A south pedestrian crossing 160*a* is located between the south pedestrian movement surface indicator 150*a* and the south traffic movement surface indicator 120*a*. Likewise, a north pedestrian movement surface indicator 150*b* is adjacent to the north side of the vehicle traffic intersection 100 and parallel to the north traffic movement surface indicator 120*b*. A north pedestrian crossing 160*b* is located between the north pedestrian movement surface indicator 150*b* and the north traffic movement surface indicator 120*b*.

A west pedestrian movement surface indicator 150*c* is adjacent to the west side of the vehicle traffic intersection 100 and parallel to the west traffic movement surface indicator 120*c*. A west pedestrian crossing 160*c* is located between the west pedestrian movement surface indicator 150*c* and the west traffic movement surface indicator 120*c*.

An east pedestrian movement surface indicator 150*d* is adjacent to the east side of the vehicle traffic intersection 100 and parallel to the east traffic movement surface indicator 120*d*. An east pedestrian crossing 160*d* is located between the east pedestrian movement surface indicator 150*d* and the east traffic movement surface indicator 120*d*.

Each of the pedestrian movement surface indicators 150 are initiated via respective signals from the communications server 110 when the communications server 110 determines it is safe for pedestrians to cross within the respective pedestrian crossing 160. For example, the south pedestrian movement surface indicator 150*a* is illuminated, via a signal from the communications server 110 when traffic is moving through the vehicle traffic intersection 100 in eastbound and westbound directions, and when southeast and southwest right-turn traffic surface movement indicators 130*a* and 130*d* respectively are not activated and when southeast and southwest left-turn traffic surface movement indicators 140*a* and 140*d* respectively are not activated. In similar examples, respective pedestrian movement surface indicators 150 are illuminated when there is no authorized traffic movement through the associated pedestrian movement surface indicator 150.

Figure 2:
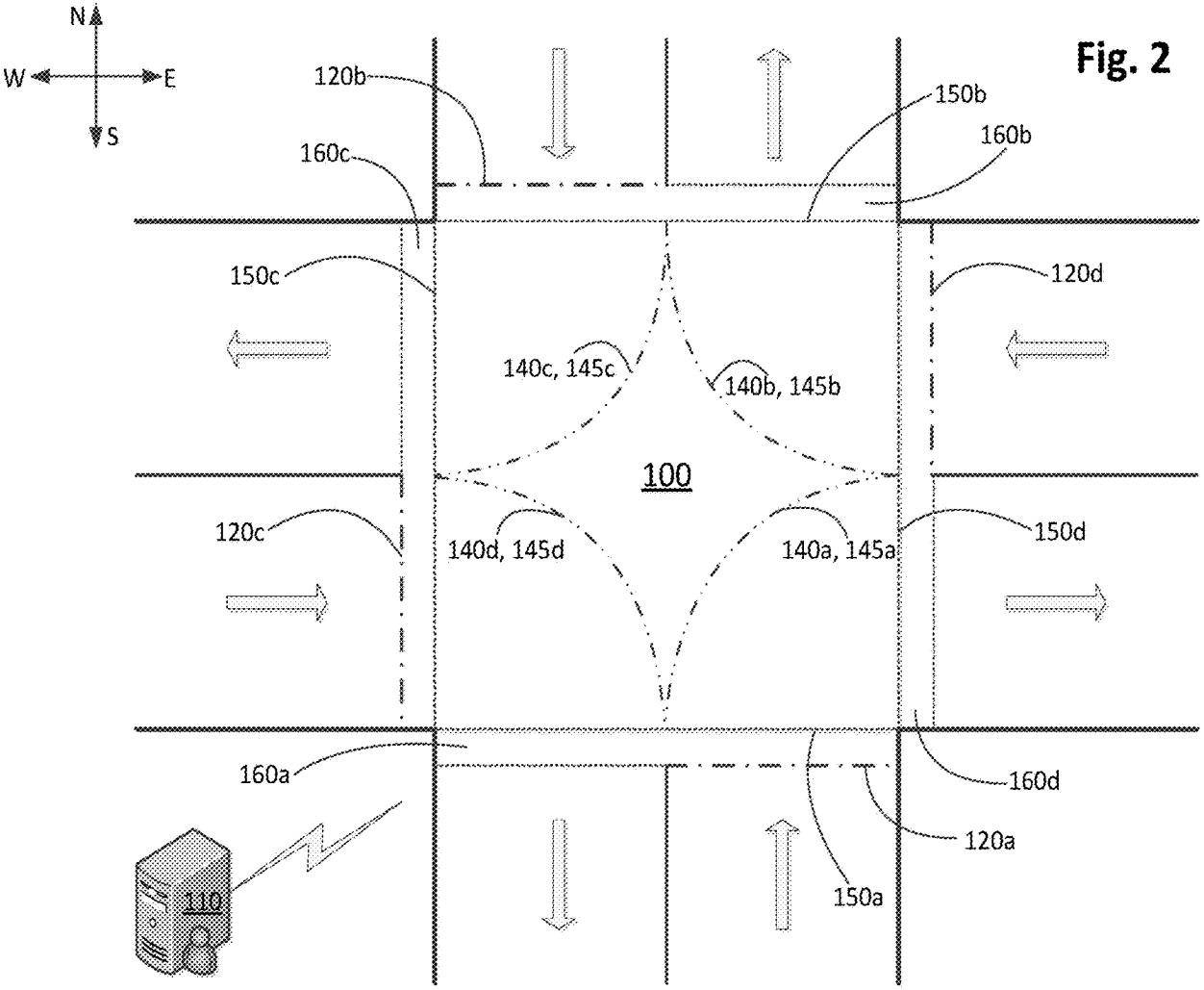
FIG. 2 is a block diagram illustrating an exemplary vehicle traffic intersection with one lane of traffic traveling in each direction according to one embodiment.

FIG. 2 is a block diagram illustrating the vehicle traffic intersection 100 in which there is just one lane of traffic traveling in each direction of a first street and a second street. Numbered features in FIG. 2 are the same as like-numbered features in FIG. 1.

Since there is only one lane traveling in each direction of the first street and the second street, it is not necessary to have separate right-turn traffic direction surface indicators 130 and left-turn traffic direction surface indicators 140. Most local traffic laws allow a right turn to be made when it is determined to be safe. For example, when a vehicle intersection traffic movement indicator is a traffic signal, a vehicle can make a right turn from a first street onto a second street at a stop signal when there is no approaching traffic coming towards the vehicle traffic intersection 100 on the second street. However, if a right turn at a stop signal is not allowed by local traffic laws, the traffic movement surface indicator 120 can be illuminated to alert a driver of a vehicle or direct a driverless vehicle to remain stopped until illumination of the traffic movement surface indicator 120 has subsided.

In FIG. 2, left-turn traffic direction surface indicators 140 can be initiated by the communications server 110 when the communications server 110 has determined that the associated left turn is safe to do so. In another embodiment, dual-purpose traffic direction surface indicators 145 can be employed as left turn and right turn traffic direction surface indicators controlled by the communications server 110.

In an embodiment, the vehicle intersection traffic movement indicator is a flashing stop signal. For example, traffic signals associated with the vehicle traffic intersection 100 can operate as timed signals during heavy traffic usage, such as day-time hours and convert to a flashing stop signal on a first street and a flashing caution signal on a second street during light traffic usage, such as night-time hours. In another embodiment, the vehicle intersection traffic movement indicator is a flashing stop sign or just a stop sign with no associated flashing light. In these embodiments, it is necessary for the communications server 110 to monitor movement of each individual vehicle in and around the vehicle traffic intersection 100.

In the absence of traffic signals in the vehicle traffic intersection 100, motion sensors can be configured adjacent to the approaching lanes leading up to the vehicle traffic intersection 100, such as the right lanes of all four approaching directions. In another example, a pressure sensor can be configured within the driving lanes leading up to the vehicle traffic intersection 100. The motion sensors or the pressure sensors can be positioned a predetermined stopping distance behind the traffic movement surface indicators 120. When a motion sensor or pressure sensor has been activated by a vehicle, a signal is sent to the communications server 110. The communications server 110 transmits a signal to the associated traffic movement surface indicator 120 to alert a driver of a vehicle to stop. The predetermined stopping distance can depend upon the posted speed limit, wherein a larger predetermined stopping distance is applied on a street or highway with a higher speed limit and a smaller predetermined stopping distance is applied on a street or highway with a lower speed limit. For example, the predetermined stopping distance can range from approximately 100-200 feet behind each traffic movement surface indicator 120 when the traffic is required to stop at the vehicle traffic intersection 100.

In FIG. 2, all four directions of traffic can be directed to stop at the vehicle traffic intersection 100, wherein all four directions of traffic encounter a flashing stop signal, a flashing stop sign, or a stop sign. The traffic movement surface indicator 120 is configured to illuminate for a predetermined amount of time after the respective motion sensor or pressure sensor has been activated when the communications server 110 has determined that it is not safe to proceed through the vehicle traffic intersection 100. In a four-way stop vehicle traffic intersection 100, the communications server 110 transmits a signal to end illumination of the respective traffic movement surface indicator 120 when no other motion sensors or pressure sensors in the other three traffic directions have been activated.

If a first vehicle traveling northbound has activated its motion sensor or pressure sensor and a second vehicle traveling southbound in an opposite direction has activated its motion sensor or pressure sensor, the communications server 110 transmits a signal to illuminate each respective traffic movement surface indicator 120*a* and 120*b*. At the end of their predetermined amount of time, the communications server 110 deactivates illumination of the respective traffic movement surface indicators 120*a* and 120*b* when there are no approaching eastbound or westbound vehicles (i.e. the traffic movement surface indicators 120*c* and 120*d* have not been activated).

In another embodiment, illumination of a particular traffic movement surface indictor 120 is illuminated only when vehicle(s) are present in a cross-directional path. For example, the north traffic movement surface indicator 120*b* and the south traffic movement surface indicator 120*a* are not illuminated unless a monitored vehicle is present at either the west traffic movement surface indicator 120*c* or the east traffic movement surface indicator 120*d*.

However, if an eastbound or westbound vehicle has activated its respective motion sensor or pressure sensor, the communications server 110 continues to illuminate the traffic movement surface indicators 120*a* and/or 120*b* until the predetermined amount of time for passage of the eastbound or westbound vehicle through the vehicle traffic intersection 100 has ended. At that time, the communications server 110 transmits a signal to deactivate illumination of the northbound or southbound vehicle's traffic movement surface indicator 120*a* or 120*b*.

When a northbound vehicle (or southbound vehicle) and a westbound vehicle (or eastbound vehicle) reach the vehicle traffic intersection 100 at approximately the same time and are stopped at their respective illuminated traffic movement surface indicators 120, the communications server 110 will deactivate the respective traffic movement surface indicator 120 of the vehicle positioned to the right of the other vehicle. However, other procedures can be programmed, via the processing circuitry of the communications server 110, which can be determined according to local traffic laws.

In another embodiment, only two directions are configured to stop, while the other two directions are configured to proceed through the vehicle traffic intersection 100 without stopping. For example, northbound and southbound traffic are required to stop, while eastbound and westbound traffic are allowed to proceed through the vehicle traffic intersection 100 without stopping.

In the example above, the northbound and southbound lanes have motion sensors or pressure sensors positioned at approximately 100-200 feet behind their associated traffic movement surface indicators 120. When the motion sensor or pressure sensor is activated by a vehicle traveling north or south, a signal is transmitted to the communications server 110, and the communications server 110 transmits a signal to illuminate the respective traffic movement surface indicator 120.

Since the eastbound and westbound traffic is not required to stop prior to passing through the vehicle traffic intersection 100, their respective motion sensors or pressure sensors are located farther behind each traffic movement surface indicator 120. In an example, a predetermined caution distance for approaching vehicles not required to stop at the vehicle traffic intersection 100 can be in a range of 150-300 feet behind their associated traffic movement surface indicators 120. When an eastbound or westbound vehicle activates a first motion sensor or pressure sensor at the predetermined caution distance, a signal is transmitted to the communications server 110. A second motion sensor or pressure sensor is positioned at the far side of the vehicle traffic intersection 100. The second motion sensor or pressure sensor is activated and transmits a signal to the communications server 110 to indicate the associated vehicle has passed through the vehicle traffic intersection 100. The time to travel from the first motion sensor or pressure sensor to the second motion sensor or pressure sensor can be deemed to be a safe zone time interval. The safe zone time interval is dependent in part, upon the speed limit of the respective street or highway and the distance between the first motion sensor or pressure sensor to the second motion sensor or pressure sensor.

In an example, a northbound or southbound vehicle has activated its associated motion sensor or pressure sensor within the safe zone time interval. This can occur when an eastbound or westbound vehicle is presently traveling within its associated first and second motion sensor or pressure sensor and therefore, it is not safe for a northbound or southbound vehicle to proceed through the vehicle traffic intersection 100. The respective traffic movement surface indicator 120*a* or 120*b* is activated and remains activated until the eastbound or westbound vehicle has passed through the vehicle traffic intersection 100.

The vehicle traffic intersection 100 and the communications server 110 of FIG. 2 can be configured as a combination of a one-way street, wherein all lanes are traveling north or all lanes are traveling south, or a one-way street in which all lanes are traveling east or all lanes are traveling west, while the second street is a two-way street. If the first street is a northbound one-way street, the south traffic movement surface indicator 120*a* would extend across both lanes of the northbound one-way street. The north traffic movement surface indicator 120*b* would not be present. Most of the left-turn traffic direction surface indicators 140 and dual-purpose traffic direction surface indicators 140 would also need to be modified or eliminated. For example, left-turning or right-turning traffic would not be directed in a southbound direction since there are no southbound lanes. In addition, the right lane of the northbound street or highway would not be directed to turn left onto the westbound street or highway because it would cross over the left lane of the northbound street or highway. Other traffic flow patterns for the vehicle traffic intersection 100 and the communications server 110 are contemplated by embodiments described herein.

Figure 3:
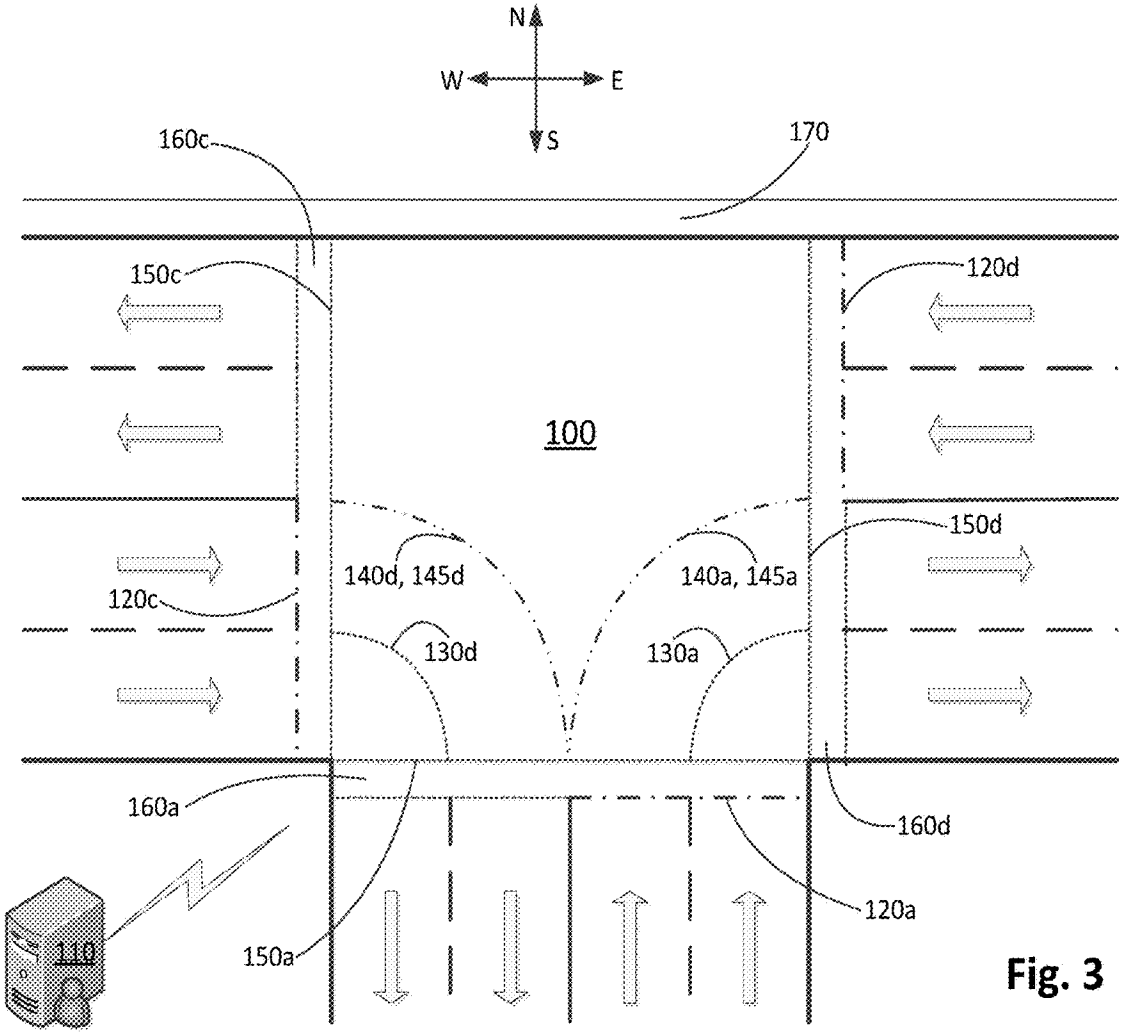
FIG. 3 is a block diagram illustrating an exemplary vehicle traffic intersection for a T-intersection according to one embodiment.

FIG. 3 is a block diagram illustrating the vehicle traffic intersection 100 and the communications server 110 for a T-intersection in which there are three directions of traffic flow. Numbered features in FIG. 3 are the same as like-numbered features in FIG. 1. The northbound and southbound street or highway does not extend north beyond the vehicle traffic intersection 100. Therefore, there are no right-turn traffic direction surface indicators 130*b* and 130*c*, and there are no left-turn traffic direction surface indicators 140*b* and 140*c* or dual-purpose traffic direction surface indicators 145*b* and 145*c*. The north edge of the vehicle traffic intersection 100, as well as the north side of the westbound street is configured with a sidewalk/shoulder 170.

Other configurations of FIG. 3 are also contemplated by embodiments described herein. For example, either the northbound/southbound street or the eastbound/westbound street can be a one-way street, while the other street is a two-way street. Also, the eastbound lanes and the westbound lanes could have just one lane in each direction, while the northbound/southbound street is a two-lane street. Traffic movement surface indicators 120, right-turn traffic direction surface indicators 130, left-turn traffic direction surface indicators 140, and dual-purpose traffic direction surface indicators 145 would be modified or eliminated, depending upon the specific traffic pattern configuration.

Several enhancements can be made to the embodiments described herein. In one embodiment, the processing circuitry of the communications server 110 can be programmed to work in conjunction with a real-time local traffic advisory source. For example, the time intervals for a traffic signal can be programmed for a longer interval on a first street and a shorter interval on a second street through a vehicle traffic intersection 100 to accommodate heavy traffic in a particular area. In addition, right-turn, left-turn, and dual-purpose traffic direction surface indicators 130, 140, and 145, respectively can be shortened in activation time or temporarily eliminated to avoid congestion in certain areas.

In another embodiment, the processing circuitry of the communications server 110 can be programmed to work in conjunction with a Mobile Infra-Red Transmitter (MIRT) or other device used by authorized personnel, such as police, fire, and ambulance vehicles. The processing circuitry can control signals to any one of the vehicle intersection traffic movement indicator, the traffic movement surface indicator, the pedestrian lane surface indicator, and the one or more traffic direction surface indicators according to signals received from a MIRT device to provide a clear path for the authorized vehicle(s).

In another embodiment, an intensity of illumination of any one of the vehicle intersection traffic movement indicator, the traffic movement surface indicator, the pedestrian lane surface indicator, and the one or more traffic direction surface indicators can be increased to accommodate periods of low visibility within a vehicle traffic intersection 100. For example, the processing circuitry of the communications server 110 can be programmed to work in conjunction with a local weather source. As a result, a higher intensity illumination can be provided during periods of rain, snow, and fog. In another example, a higher intensity of illumination can be provided during periods from sundown to sunrise when visibility is lower.

Figure 4A:
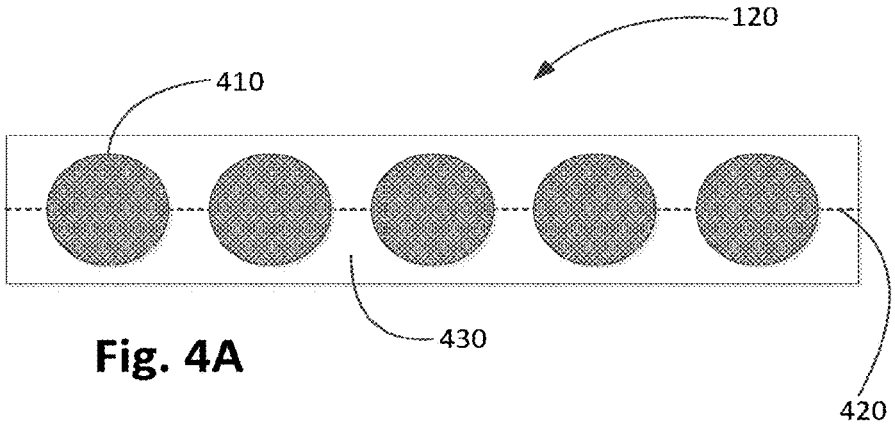
FIG. 4A illustrates a partial upper view of a traffic movement surface indicator according to one embodiment.

FIG. 4A illustrates a partial upper view of a traffic movement surface indicator 120. A plurality of lights 410, such as LEDs is interconnected, via a plurality of wire connections 420. The plurality of lights 410 are illustrated as being round. However, other geometries, such as a square, a rectangle, a triangle, or various polygon combinations can be used with embodiments described herein. The plurality of lights 410 within each traffic direction and movement surface indicator 120, 130, 140, or 145 can be configured to provide a constant illumination, a flashing illumination, or a streaming illumination of the interconnected lights 410.

The plurality of lights 410 are adhered to a mount 430. The mount 430 includes the wire connections 420 and one or more electronic devices, as well as a structural plate and anchor pegs, which are all described in more detail with reference to FIG. 4C. In the traffic movement surface indicator 120, the plurality of lights 410 can be oriented such that most of the illumination is directed away from the vehicle traffic intersection 100 and towards an approaching or stopped vehicle sitting behind the traffic movement surface indicator 120.

Figure 4B:
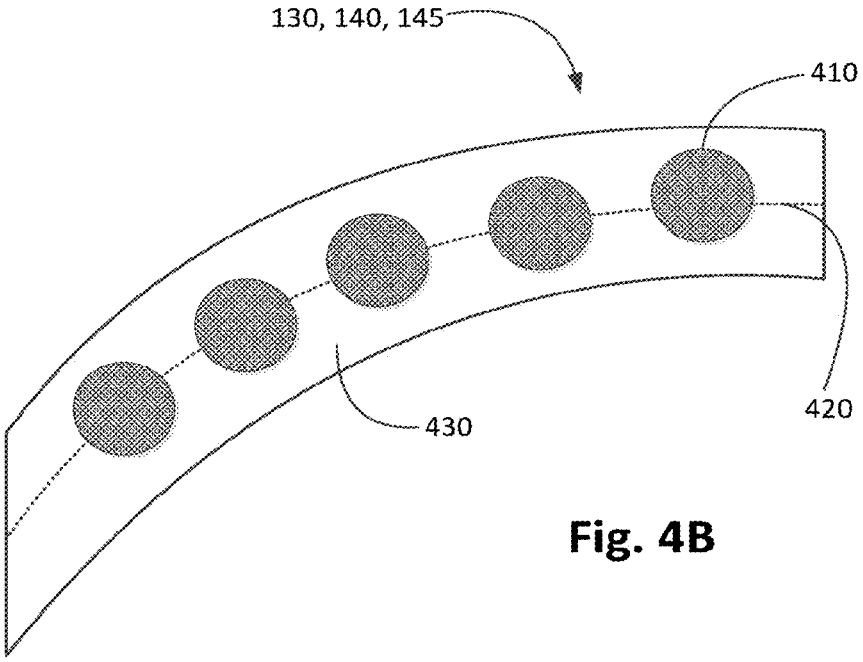
FIG. 4B illustrates a partial upper view of a traffic direction surface indicator according to one embodiment.

FIG. 4B illustrates a partial upper view of a right-turn traffic direction surface indicator 130, a left-turn traffic direction surface indicator 140, and a dual-purpose traffic direction surface indicator 145. The plurality of lights 410 are adhered to a mount 430. The mount 430 includes the wire connections 420 and one or more electronic devices, as well as a structural plate and anchor pegs, which are all described in more detail with reference to FIG. 4C.

In the right-turn and left-turn traffic surface direction indicators 130 and 140, respectively, the plurality of lights 410 can be oriented such that most of the illumination is directed towards the left driver's side of a vehicle that travels adjacent to the particular traffic surface direction indicator. With reference to FIG. 1, the plurality of lights 410 of the southeast right-turn traffic direction surface indicator 130*a* can have the majority of illumination directed to the right in FIG. 1 towards the southeast corner of the vehicle traffic intersection 100. This directs most of the illumination towards a driver of a vehicle traveling next to the southeast right-turn traffic direction surface indicator 130*a*. The plurality of lights 410 of the southeast left-turn traffic surface direction indicator 140*a* can have the majority of illumination directed to the left in FIG. 1 towards the northwest corner of the vehicle traffic intersection 100. This directs most of the illumination towards a driver of a vehicle traveling next to the southeast left-turn traffic surface direction indicator 140*a*.

In the dual-purpose traffic surface direction indicators 145, the plurality of lights 410 can be oriented in two directions for each of the two purposes of the dual-purpose traffic surface direction indicators 145. With reference to the dual-purpose traffic surface direction indicator 145*a* of FIG. 1, a portion of the lights 410 can have their illumination directed to the right towards the southeast corner of the vehicle traffic intersection 100 to function as a second right-turn traffic direction surface indicator for a vehicle traveling north and turning east. Another portion of the lights 410 can have their illumination directed to the left towards the northwest corner of the vehicle traffic intersection 100 to function as a left-turn traffic direction surface indicator for a vehicle traveling west and turning south. For example, the illumination of half of the lights 410 of the dual-purpose traffic direction surface indicator 145*a* can be directed towards the southeast corner of the vehicle traffic intersection 100, and the illumination of the other half of the lights 410 of the dual-purpose traffic direction surface indicator 145*a* can be directed towards the northwest corner of the vehicle traffic intersection 100.

In addition, the lights 410 of the dual-purpose traffic direction surface indicator 145*a* oriented towards the southeast corner of the vehicle traffic intersection 100 can be a particular color to coincide with the directed traffic movement, and the lights 410 oriented towards the northwest corner of the vehicle traffic intersection 100 can be another particular color to coincide with the directed traffic movement according to signals received from the communications server 110. For example, given for illustrative purposes only, both sets of lights 410 can be green when the communications server 110 has determined that traffic can proceed forward along both routes. Both sets of lights 410 can be red when the communications server 110 has determined that traffic should not proceed forward along either route. A first set of lights 410 can be red when the communications server 110 has determined that traffic should not proceed along an associated first route, and a second set of lights 410 can be green when the communications server 110 has determined that traffic can proceed along an associated second route.

Figure 4C:
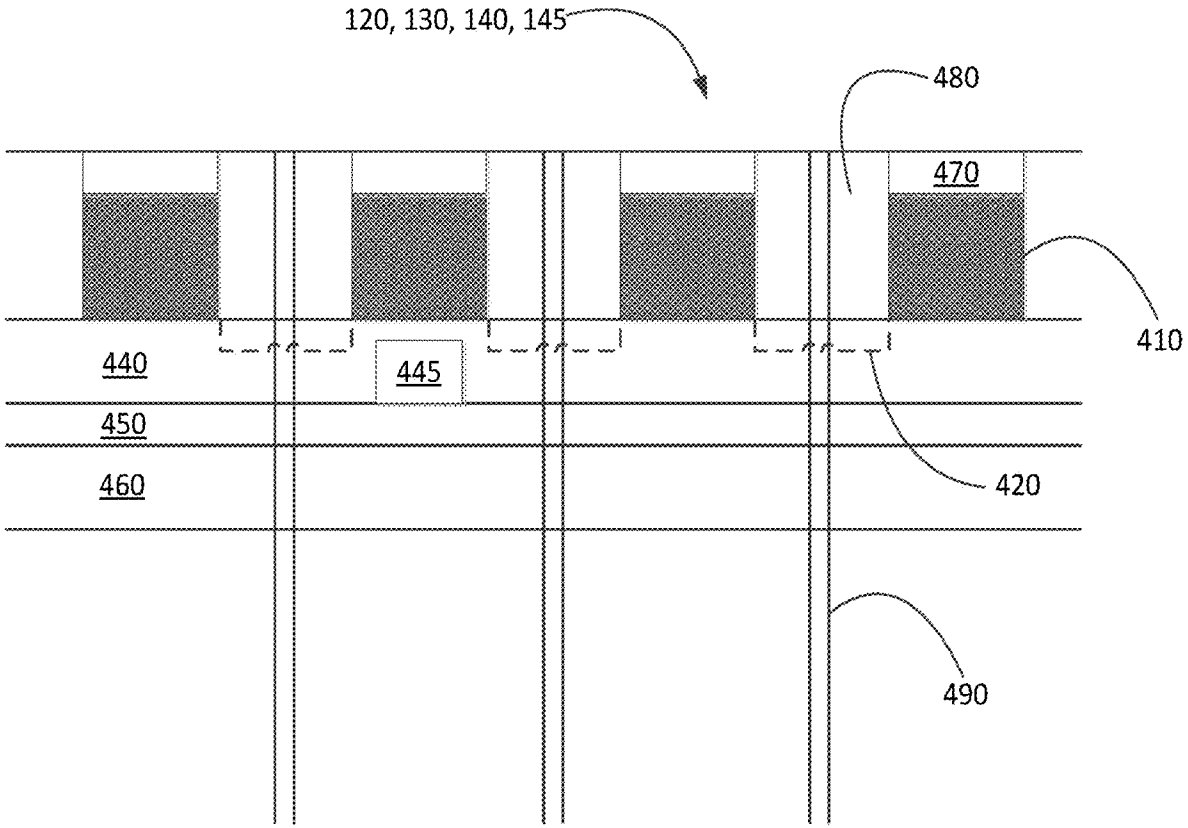
FIG. 4C is a cross-sectional partial view of a traffic surface indicator according to one embodiment.

FIG. 4C is a cross-sectional partial view of a traffic movement surface indicator 120, a right-turn traffic direction surface indicator 130, a left-turn traffic direction surface indicator 140, and a dual-purpose traffic direction surface indicator 145. A plurality of lights 410 are interconnected by a plurality of wire connections 420. The plurality of lights 410 are adhered to a plurality of layers, described as a mount 430 in FIGS. 4A and 4B.

A first layer 440 includes a flexible layer, such as vulcanized rubber. The first layer 440 needs to be resistant to weather conditions, pressure, stress, and strain in order to withstand being driven across by various vehicles over an extended period of time. The first layer 440 has the plurality of wire connections 420 embedded within the material of the first layer 440. The first layer 440 also has one or more embedded electronic devices 445. The electronic devices 445 include transceivers that are configured to transmit and receive signals to and from the communications server 110.

A second layer 450 includes a structural layer, such as a metal or metal alloy layer that is configured to provide structural support and rigidity to the traffic direction and movement surface indicators 120, 130, 140, and 145. The second layer 450 should also be resistant to weather conditions, pressure, stress, and strain in order to withstand being driven across by various vehicles over an extended period of time. For example, the second layer 450 can be stainless steel or another material having stainless steel belts embedded within the material.

A third layer 460 provides a bottom supporting layer that is directly attached to an underlying street surface, such as asphalt, concrete, or brick. The third layer 460 should be a flexible layer and be resistant to weather conditions, pressure, stress, and strain in order to withstand being driven across by various vehicles over an extended period of time. The third layer 460 can also be vulcanized rubber, for example.

A protective cover 470 is affixed over each of the lights 410. The protective cover 470 needs to be transparent to allow light rays from the lights 410 to pass through and provide illumination to the external environment. The protective cover 470 also needs to be rugged to withstand being driven across by various vehicles over an extended period of time. The protective cover 470 can have embedded fibers to provide additional support against traffic flow.

A top protective layer 480 is formed around each of the lights 410 to provide structural support to the lights 410. The top protective layer 480 can be a molded encapsulation material or directionally flowed between the lights 410 and subsequently cured to form a hardened top protective layer 480. For example, rubber can be used as the top protective layer 480.

A plurality of anchor pegs 490 are intermittently spaced between the lights 410 along the length of the traffic direction and movement surface indicators 120, 130, 140, and 145. The anchor pegs 490 extend beyond the bottom of the third layer 460 to anchor the traffic direction and movement surface indicators 120, 130, 140, and 145 to the underlying street material. The anchor pegs 490 have a sufficient diameter to remain anchored to the street material upon repeated pressure, stress, and strain from traffic flow over an extended period of time. The anchor pegs 490 can be in the form of a screw or bolt to provide anchoring forces along the full length of the anchor pegs 490. The anchor pegs 490 can also include horizontally-extending barbs near the bottom end of the anchor peg 490 to provide additional support and anchoring forces.

In an embodiment, the traffic direction and movement surface indicators 120, 130, 140, and 145 can also provide enhanced safe driving through the vehicle traffic intersection 100. The traffic direction and movement surface indicators 120, 130, 140, and 145 are of sufficient height above the street surface and are made of a hard material, such that driving onto or across one of the traffic direction and movement surface indicators 120, 130, 140, and 145 has the effect of driving onto or across a speed bump or rumple strip used to caution or alert drivers. The combination of light illumination and projections provide a smooth and safe flow of traffic through the vehicle traffic intersection 100.

Another safety enhancement includes an auditory signal when one of the traffic direction and movement surface indicators 120, 130, 140, and 145 has been activated. An auditory device can be positioned on or near the particular vehicle intersection traffic movement indicator, such as a traffic signal, a stop sign, a flashing stop sign, or a flashing stop indicator of the vehicle traffic signal. The auditory signal can be any particular sound that would be loud enough to alert a driver within a vehicle. In an embodiment, each vehicle intersection traffic movement indicator within a vehicle traffic intersection 100 can have a different auditory signal. The auditory signal can be used in addition to the light illumination and the surface projections of the traffic direction and movement surface indicators 120, 130, 140, and 145.

Figure 5:
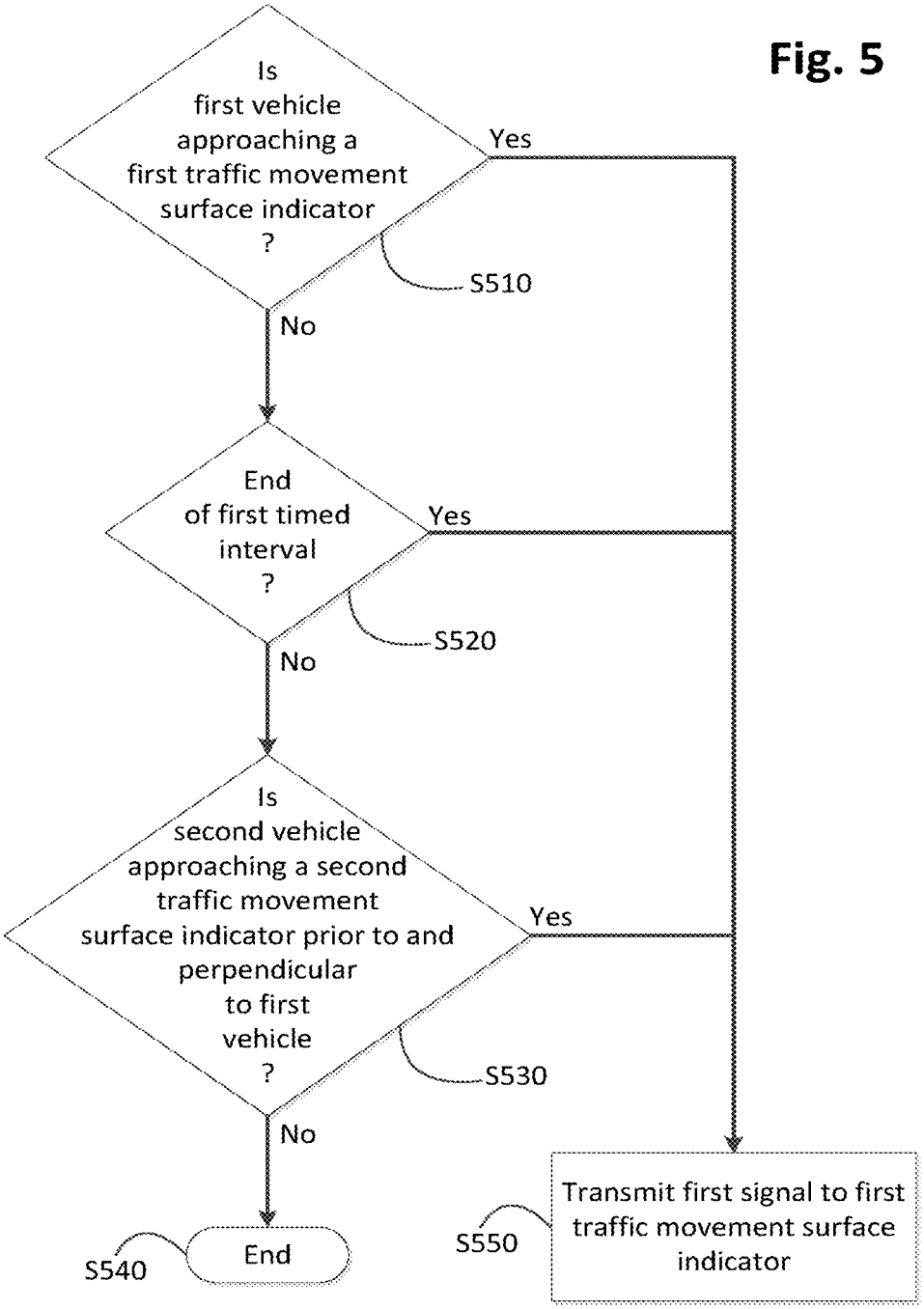
FIG. 5 is an algorithm for determining when a first signal is transmitted to a first traffic movement surface indicator according to one embodiment.

FIG. 5 is an algorithm for determining when a first signal is transmitted to a first traffic movement surface indicator, such as one of the traffic movement surface indicators 120*a*-120*d* when a first monitored event occurs. Each traffic movement surface indicator is positioned behind an edge of a vehicle traffic intersection, such as vehicle traffic intersection 100. The traffic movement surface indicator directs a driver of a vehicle (or a driverless vehicle) to proceed through a vehicle traffic intersection when the vehicle traffic intersection is clear of other cross-traffic vehicles.

In step S510, it is determined whether a first vehicle is approaching the first traffic movement surface indicator. This can be determined, via one or more motion sensors or pressure sensors positioned a predetermined distance behind the first traffic movement surface indicator. The predetermined distance can depend in part on the posted speed limit of the street or highway in which the first vehicle is traveling towards the vehicle traffic intersection.

If a first vehicle is approaching the first traffic movement surface indicator ("YES" in step S510), the process proceeds to step S550, in which a first signal is transmitted to the first traffic movement surface indicator. The transmission of the first signal occurs via processing circuitry of a communications server. If a first vehicle is not approaching the first traffic movement surface indicator ("NO" in step S510), the process proceeds to step S520.

In step S520, it is determined whether a first timed interval has ended. This can be determined, via a vehicle intersection traffic movement indicator, such as a vehicle traffic signal, a flashing stop sign, or a flashing stop indicator of the vehicle traffic signal. The first timed interval can be a time interval in which the vehicle traffic signal is in a forward movement state, such as a green light. When the first timed interval has ended, the vehicle traffic signal is in a stopped movement state, such as a red light.

If the first timed interval has ended ("YES" in step S520), the process proceeds to step S550, in which a first signal is transmitted to the first traffic movement surface indicator. The transmission of the first signal occurs via processing circuitry of a communications server. If the first timed interval has not ended ("NO" in step S520), the process proceeds to step S530.

In step S530, it is determined whether a second vehicle is approaching a second traffic movement surface indicator prior to and perpendicular to the first vehicle. This can be determined, via one or more motion sensors or pressure sensors positioned a predetermined distance behind the second traffic movement surface indicator. The predetermined distance can depend in part on the posted speed limit of the street or highway in which the second vehicle is traveling towards the vehicle traffic intersection. The second vehicle can be located to the right or to the left of the first vehicle in its approach towards the vehicle traffic intersection.

If the second vehicle is approaching the second traffic movement surface indicator prior to and perpendicular to the first vehicle ("YES" in step S530), the process proceeds to step S550, in which a first signal is transmitted to the first traffic movement surface indicator. This step alerts a driver of the first vehicle to remain stopped at the first traffic movement surface indicator while the second vehicle passes through the vehicle traffic intersection. The transmission of the first signal occurs via processing circuitry of a communications server. If the second vehicle is not approaching the second traffic movement surface indicator prior to and perpendicular to the first vehicle ("NO" in step S530), the process ends at step S540.

Figure 6:
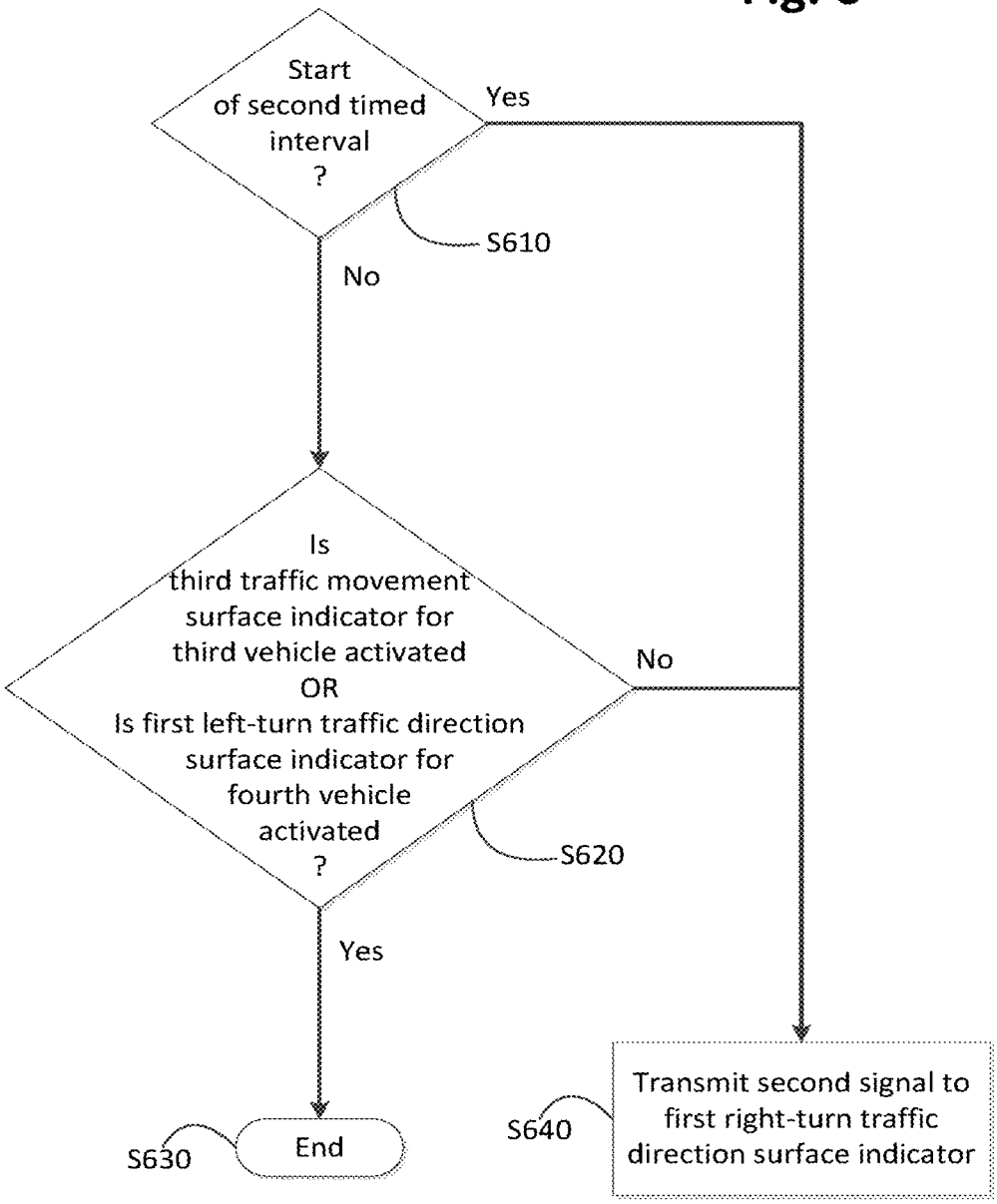
FIG. 6 is an algorithm for determining when a second signal is transmitted to a right-turn traffic direction surface indicator according to one embodiment.

FIG. 6 is an algorithm for determining when a second signal is transmitted to a first right-turn traffic direction surface indicator, such as one of the right-turn traffic direction surface indicators, 130*a*-130*d* when a second monitored event occurs. The right-turn traffic direction surface indicator directs a driver of a first vehicle (or a driverless first vehicle) to turn right from a first street to a second street. The right-turn traffic direction surface indicators are positioned on a surface of the vehicle traffic intersection and are configured in a pattern to connect one lane on the first street to an adjacent lane on the second street located to the right of the first street.

In step S610, it is determined whether a second timed interval has started. This can be determined, via a vehicle intersection traffic movement indicator, such as a vehicle traffic signal. The second timed interval can be a time interval in which the vehicle traffic signal is in a forward movement state, such as a green light.

If the second timed interval has started ("YES" in step S610), the process proceeds to step S640 in which a second signal is transmitted to the right-turn traffic direction surface indicator. The transmission of the second signal occurs via processing circuitry of a communications server. This directs a driver of a vehicle (or a driverless vehicle) to proceed through the highlighted right turn of the vehicle traffic intersection. If the second timed interval has not started ("NO" in step S610), the process proceeds to step S620.

In step S620, it is determined whether a third traffic movement surface indicator for a third vehicle is activated. The third vehicle is approaching the vehicle traffic intersection while driving on the second street in a same direction as the first vehicle after turning onto the second street. Step S620 also determines whether a first left-turn traffic direction surface indicator for a fourth vehicle is activated. The fourth vehicle is turning left into the vehicle traffic intersection from the first street to the second street.

If neither the traffic movement surface indicator for the third vehicle nor the left-turn traffic direction surface indicator for the fourth vehicle has been activated ("NO" in step S620), the process proceeds to step S640 in which a second signal is transmitted to the right-turn traffic direction surface indicator. The transmission of the second signal occurs via processing circuitry of a communications server. This directs a driver of a vehicle (or a driverless vehicle) to proceed through the highlighted right turn of the vehicle traffic intersection. If either the traffic movement surface indicator for the third vehicle or the left-turn traffic direction surface indicator for the fourth vehicle has been activated, ("YES" in step S620), the process ends at step S630.

Figure 7:
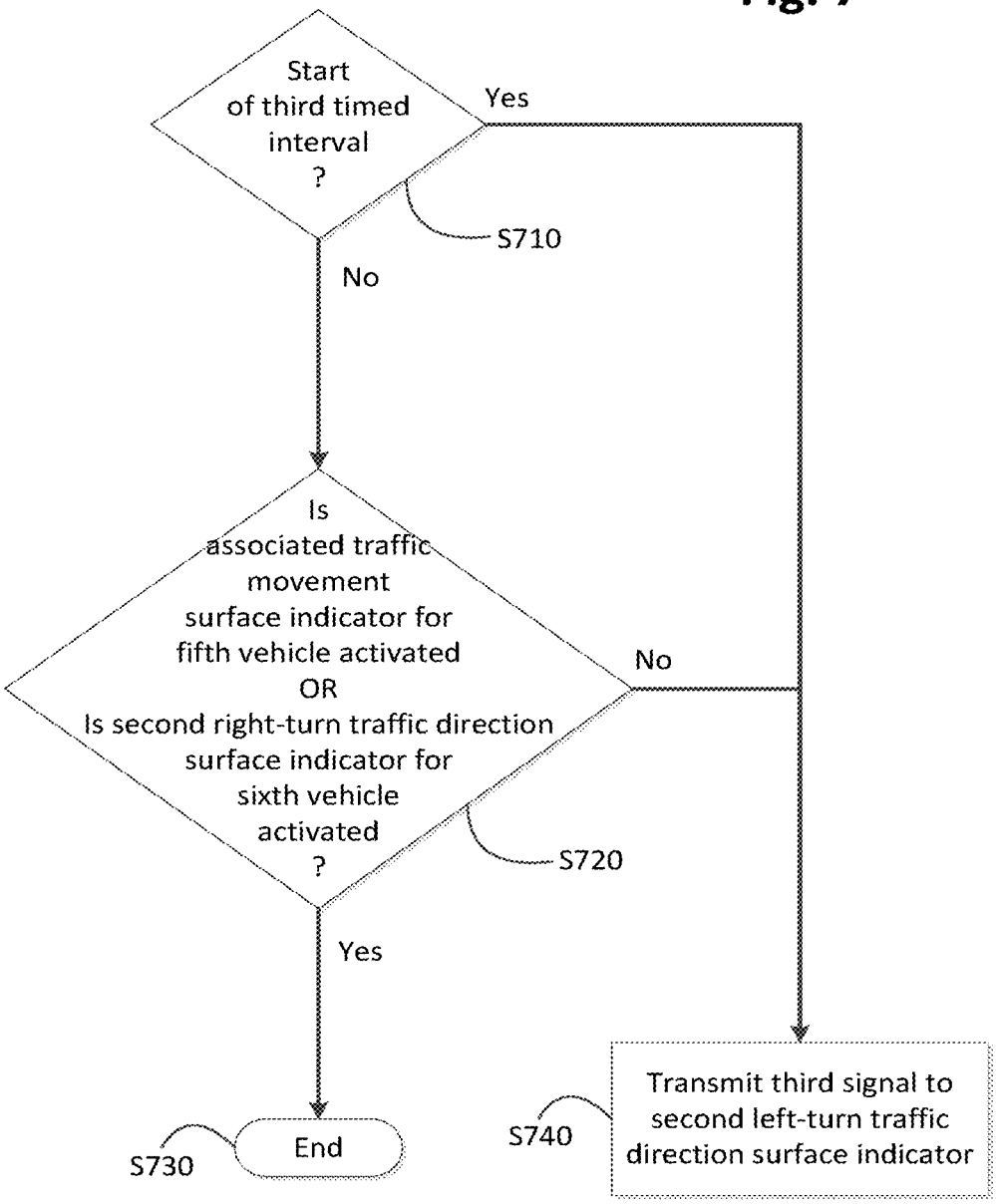
FIG. 7 is an algorithm for determining when a third signal is transmitted to a left-turn traffic direction surface indicator according to one embodiment.

FIG. 7 is an algorithm for determining when a third signal is transmitted to a second left-turn traffic direction surface indicator, such as the left-turn traffic direction surface indicators 140*a*-140*d* when a third monitored event occurs. The left-turn traffic direction surface indicators are positioned on a surface of the vehicle traffic intersection and are configured in a pattern to connect one lane of traffic on the first street to an adjacent lane of traffic on the second street located to the left of the first street. The left-turn traffic direction surface indicator directs a driver of a first vehicle (or a driverless first vehicle) to proceed through a highlighted left turn from a first street to a second street.

In step S710, it is determined whether a third timed interval has started. This can be determined, via a vehicle intersection traffic movement indicator, such as a vehicle traffic signal. The third timed interval can be a time interval in which the vehicle traffic signal is in a forward movement state, such as a green light.

If the third timed interval has started ("YES" in step S710), the process proceeds to step S740 in which a third signal is transmitted to the left-turn traffic direction surface indicator. The transmission of the third signal occurs via processing circuitry of a communications server. If the third timed interval has not started ("NO" in step S710), the process proceeds to step S720.

In step S720, it is determined whether a traffic movement surface indicator for a fifth vehicle is activated. The fifth vehicle is approaching the vehicle traffic intersection from either direction on the second street. Step S720 also determines whether a second right-turn traffic direction surface indicator for a sixth vehicle is activated. The sixth vehicle is turning right into the vehicle traffic intersection from the first street to the second street in a same direction as the first vehicle after turning onto the second street.

If neither the traffic movement surface indicator for the fifth vehicle nor the right-turn traffic direction surface indicator for the sixth vehicle has been activated ("NO" in step S720), the process proceeds to step S740 in which a third signal is transmitted to the left-turn traffic direction surface indicator. The transmission of the third signal occurs via processing circuitry of a communications server. If either the traffic movement surface indicator for the fifth vehicle or the right-turn traffic direction surface indicator for the sixth vehicle has been activated, ("YES" in step S720), the process ends at step S730.

Figure 8:
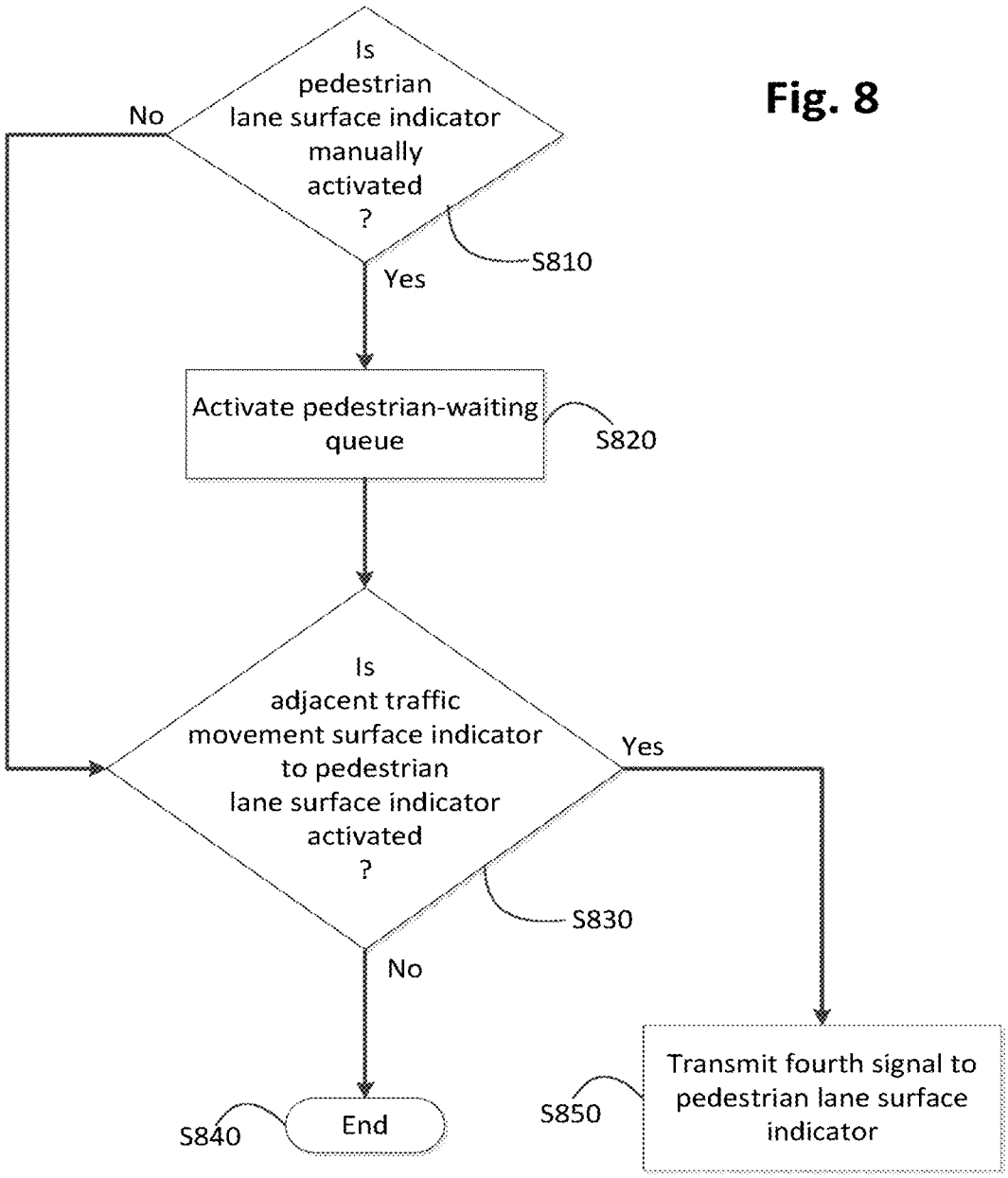
FIG. 8 is an algorithm for determining when a fourth signal is transmitted to a pedestrian lane surface indicator according to one embodiment.

FIG. 8 is an algorithm for determining when a fourth signal is transmitted to a pedestrian lane surface indicator when a fourth monitored event occurs. A pedestrian lane surface indicator is positioned adjacent to each edge of the vehicle traffic intersection, such as pedestrian lane surface indicators 150*a*-150*d*. Respective pedestrian crossings 160*a*-160*d* are located between each pedestrian lane surface indicator 150 and its associated traffic movement surface indicator 120.

In step S810, it is determined whether the pedestrian lane surface indicator is manually activated. If the pedestrian lane surface indicator was manually activated ("YES" in step S810), the process proceeds to step S820. If the pedestrian lane surface indicator has not been manually activated ("NO" in step S810), the process proceeds to step S830.

In step S820, a pedestrian-waiting queue is activated. Activation of the pedestrian-waiting queue initiates signals for other vehicle activity within the vehicle traffic intersection and across the associated pedestrian crossing to discontinue.

In step S830, it is determined whether a traffic movement surface indicator adjacent and parallel to the pedestrian lane surface indicator is activated. If the traffic movement surface indicator adjacent and parallel to the pedestrian lane surface indicator has not been activated, the process ends at step S840. If the traffic movement surface indicator adjacent and parallel to the pedestrian lane surface indicator has been activated, the process proceeds to step S850.

In step S850, a fourth signal is transmitted to the pedestrian lane surface indicator. The transmission of the fourth signal occurs via processing circuitry of a communications server. Transmission of the pedestrian lane surface indicator alerts a pedestrian that it is safe to proceed through the associated pedestrian crossing. In addition, transmission of the pedestrian lane surface indicator alerts a driver of a vehicle (or a driverless vehicle) that traveling across the highlighted pedestrian lane surface indicator is prohibited.

A hardware description of an exemplary computing device 900 used in accordance with embodiments herein is described with reference to FIG. 9A. Computing device 900 can be used as one or more servers 110 illustrated in FIGS. 1-3, such as one or more real-time servers.

Computing device 900 is intended to represent various forms of digital hardware, such as laptops, desktops, workstations, personal digital assistants, servers, blade servers, mainframes, and other appropriate computers. The components shown here, their connections and relationships, and their functions are meant to be examples only and are not meant to be limiting.

The computing device 900 includes a processor 901, a memory 902, a storage device 904, a high-speed interface 912 connecting to the memory 902 and multiple high-speed expansion ports 916, and a low-speed interface 910 connecting to a low-speed expansion port 914 and the storage device 904. Each of the processor 901, the memory 902, the storage device 904, the high-speed interface 912, the high-speed expansion ports 916, and the low-speed interface 910 are interconnected using various busses, such as communication bus 926, and may be mounted on a common motherboard or in other manners as appropriate.

The processor 901 can process instructions for execution within the computing device 900, including instructions stored in the memory 902 or on the storage device 904 to display graphical information for a GUI on an external input/output device, such as a display 908 and a speaker 920 coupled to the high-speed interface 912. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system). The memory 902 stores information within the computing device 900. In some implementations, the memory 902 is a volatile memory unit or units. In some implementations, the memory 902 is a non-volatile memory unit or units. The memory 902 can also be another form of computer-readable medium, such as a magnetic or optical disk.

The storage device 904 is capable of providing mass storage for the computing device 900. In some implementations, the storage device 904 can be or contain a computer-readable medium, such as a floppy disk device, a hard disk device, an optical disk device, a tape device, a flash memory or other similar solid state memory device, or an array of devices, including devices in a storage area network or other configurations. Instructions can be stored in an information carrier. The instructions, when executed by one or more processing devices (for example, processor 901), perform one or more methods, such as those described above. The instructions can also be stored by one or more storage devices, such as computer- or machine-readable mediums (for example, the memory 902, the storage device 904, or memory on the processor 901).

The high-speed interface 912 manages bandwidth-intensive operations for the computing device 900, while the low-speed interface 910 manages lower bandwidth-intensive operations. Such allocation of functions is an example only. In some implementations, the high-speed interface 912 is coupled to the memory 902, the display 908 (e.g., through a graphics processor or accelerator), the speaker 920, and to the high-speed expansion ports 916, which may accept various expansion cards (not shown). In the implementation, the low-speed interface 910 is coupled to the storage device 904 and the low-speed expansion port 914. The low-speed expansion port 914, which can include various communication ports (e.g., USB, Bluetooth, Ethernet, wireless Ethernet) can be coupled to one or more input/output devices 918, such as a keyboard, a pointing device, a scanner, or a networking device such as a switch or router, e.g., through a network adapter.

The computing device 900 also includes a network controller 906, such as an Intel Ethernet PRO network interface card from Intel Corporation of America, for interfacing with a network 99. As can be appreciated, the network 99 can be a public network, such as the Internet, or a private network such as an LAN or WAN network, or any combination thereof and can also include PSTN or ISDN sub-networks. The network 99 can also be wired, such as an Ethernet network, or can be wireless such as a cellular network including EDGE, 3G and 4G wireless cellular systems. The wireless network can also be Wi-Fi, Bluetooth, or any other wireless form of communication that is known.

Figure 9A:
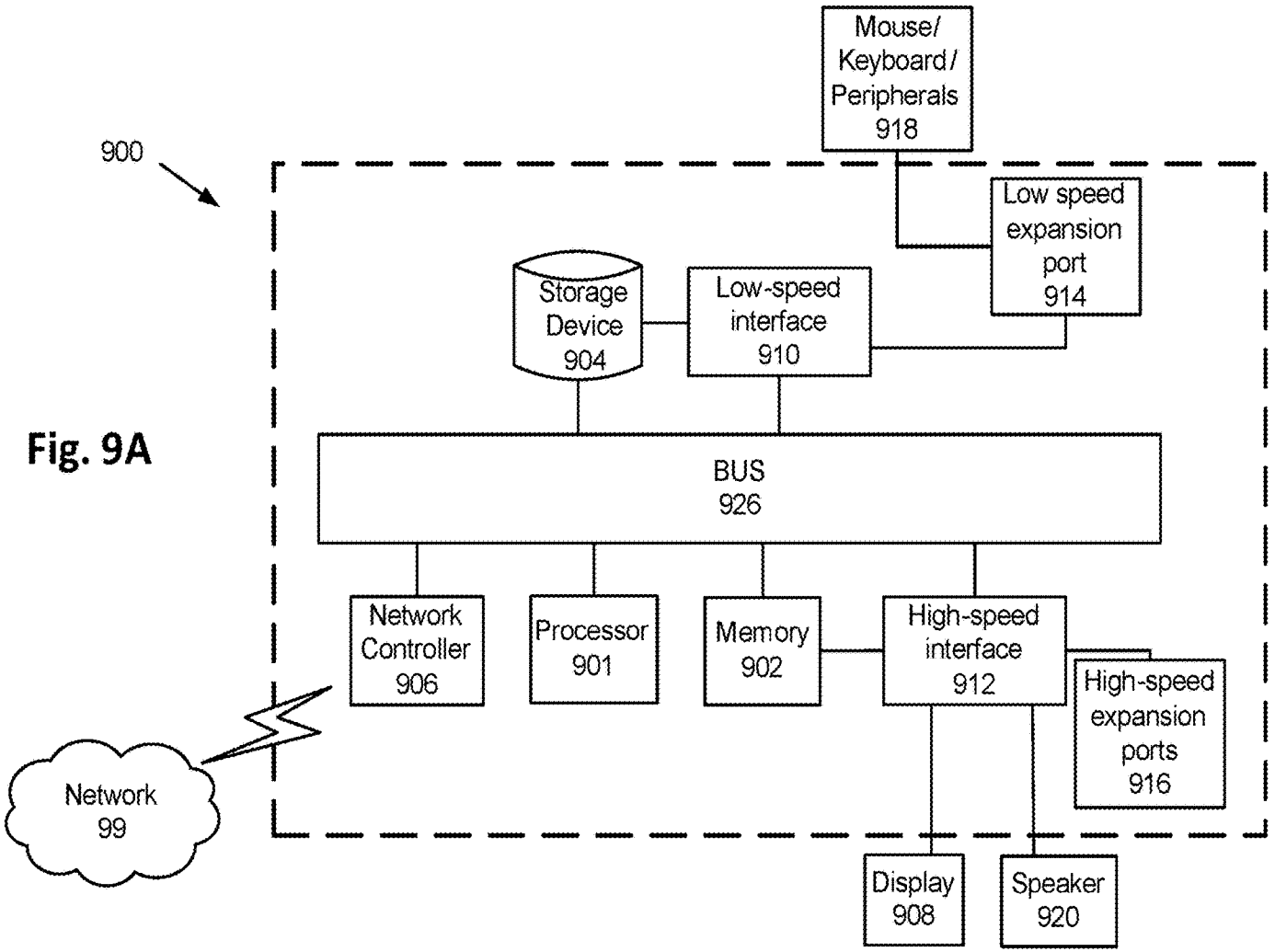
FIG. 9A is a block diagram of an exemplary computing system according to one embodiment.
Figure 9B:
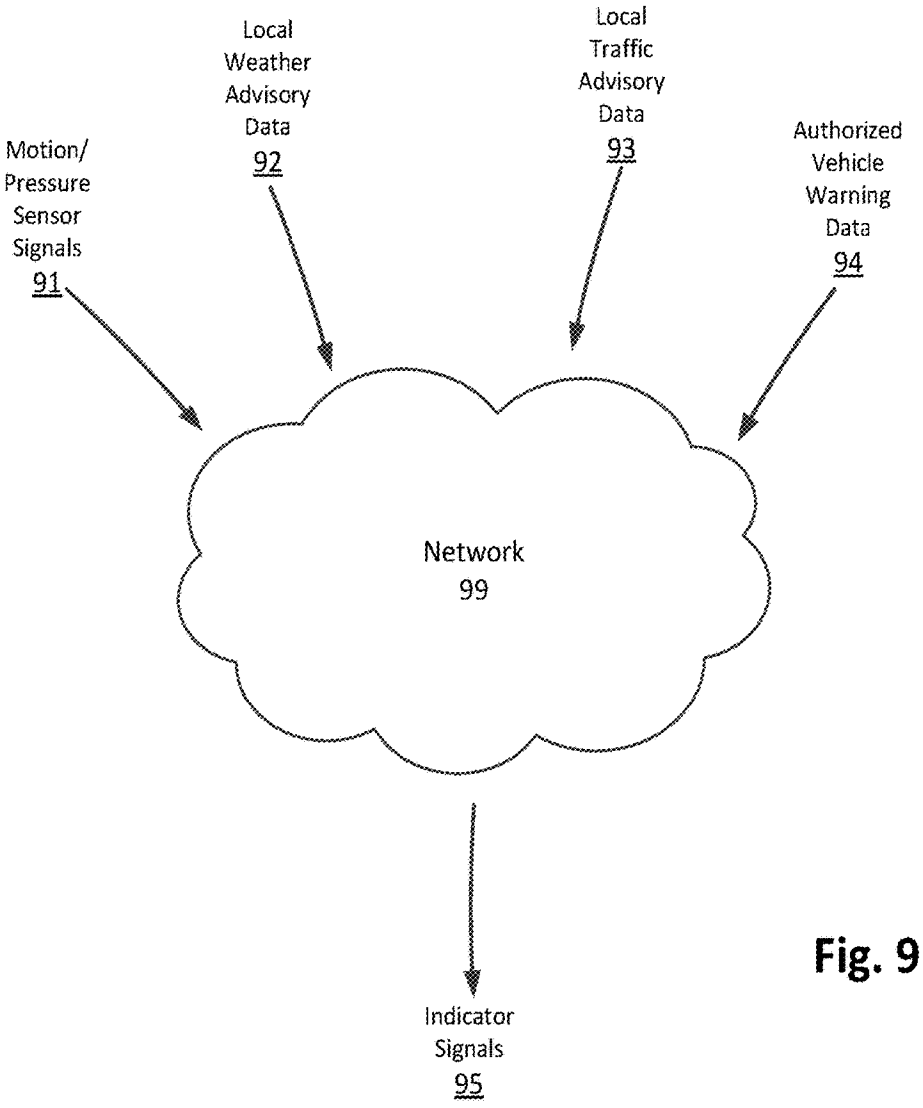
FIG. 9B illustrates an exemplary network and various inputs and outputs according to one embodiment.

FIG. 9B illustrates network 99 and various inputs and outputs according to embodiments described herein and how they interact with computing device 900 via network 99. Signals from motion/pressure sensors 91 provide input from the multiple motion and/or pressure sensors to indicate presence of a nearby vehicle. Data from a local weather advisory 92 provides input by which vehicle traffic can be managed for optimum safety, such as increasing an illumination of the various traffic movement surface indicators and the traffic direction surface indicators. Data from a local traffic advisory 93 provides input by which vehicle traffic might be varied to provide optimum and efficient traffic flow. Data from an authorized vehicle warning 94 provides a temporary pause in vehicle traffic to provide a fast traffic path for an emergency vehicle.

Network 99 outputs applicable indicator signals 95 to the various traffic movement surface indicators and the traffic direction surface indicators according to input signals and data from the motion/pressure sensors 91, the local weather advisory 92, the local traffic advisory 93, and the authorized vehicle warning 94.

Although the computing device 900 of FIG. 9A is described as having a storage medium device 904, the claimed advancements are not limited by the form of the computer-readable media on which the instructions of the described processes are stored. For example, the instructions can be stored on CDs, DVDs, in FLASH memory, RAM, ROM, PROM, EPROM, EEPROM, hard disk, or any other information processing device with which the computing device communicates.

In other alternate embodiments, processing features according to the present disclosure may be implemented and commercialized as hardware, a software solution, or a combination thereof. Moreover, instructions corresponding to processes described herein could be stored in a portable drive, such as a USB Flash drive that hosts a secure process.

Computer programs (also known as programs, software, software applications, or code) associated with the processes described herein include machine instructions for a programmable processor, and can be implemented in a high-level procedural and/or object-oriented programming language, and/or in assembly/machine language. As used herein, the terms machine-readable medium and computer-readable medium refer to any computer program product, apparatus, and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described herein can be implemented on a computer having a display device 908 (e.g., a CRT (cathode ray tube) or LCD (liquid crystal display) monitor) for displaying information to the user and a keyboard and a pointing device 918 (e.g., a mouse or a trackball) by which the user can provide input to the computer. Other kinds of devices can be used to provide for interaction with a user as well. For example, feedback provided to the user can be any form of sensory feedback (e.g., visual feedback, auditory feedback, or tactile feedback), and input from the user can be received in any form, including acoustic, speech, or tactile input.

The systems and techniques described herein can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

Figure 10:
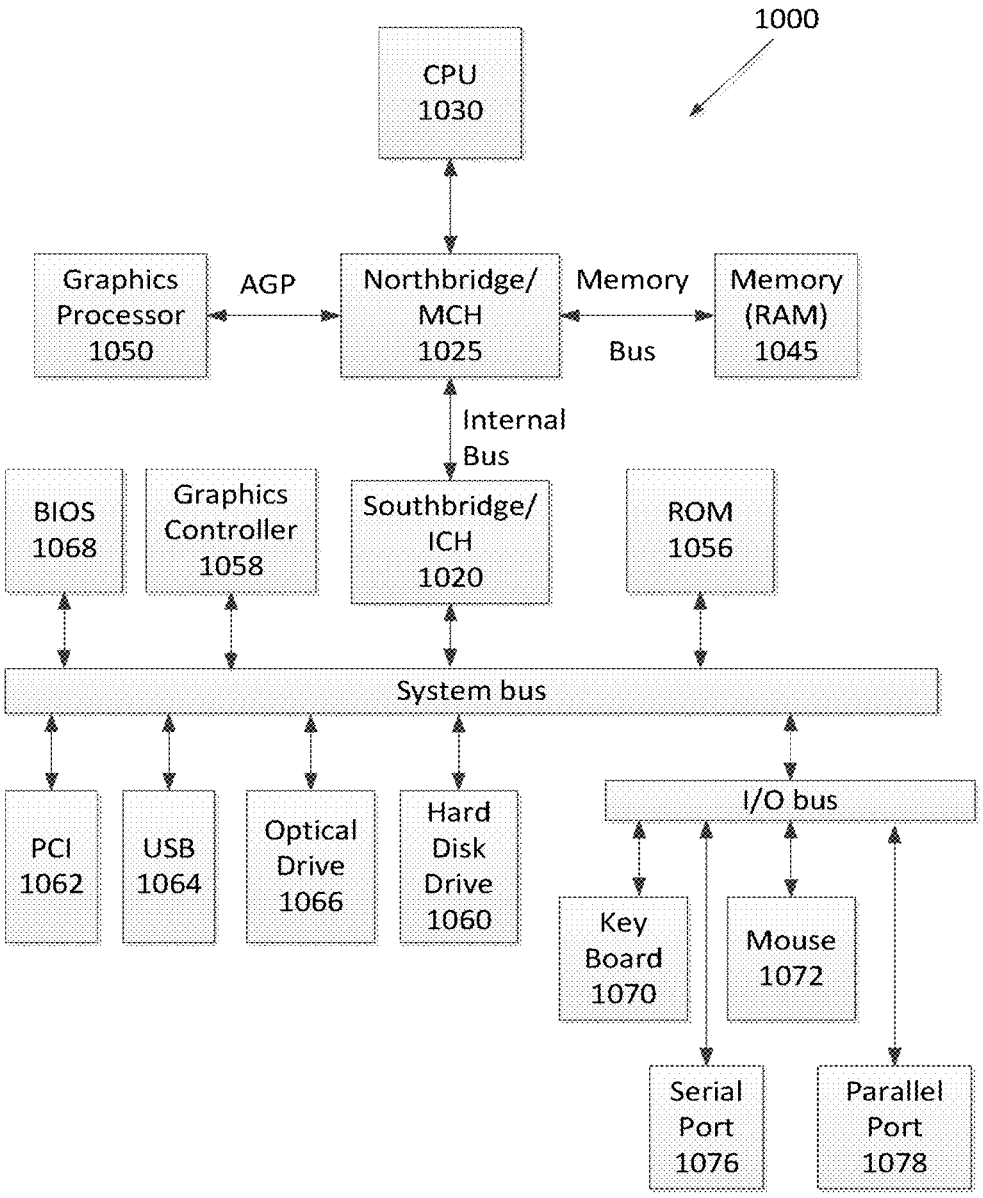
FIG. 10 is a schematic diagram of an exemplary data processing system according to one embodiment.

FIG. 10 is a schematic diagram of an exemplary data processing system, according to aspects of the disclosure described herein for performing menu navigation, as described above. The data processing system is an example of a computer in which code or instructions implementing the processes of the illustrative embodiments can be located.

In FIG. 10, data processing system 1000 employs an application architecture including a north bridge and memory controller hub (NB/MCH) 1025 and a south bridge and input/output (I/O) controller hub (SB/ICH) 1020. The central processing unit (CPU) 1030 is connected to NB/MCH 1025. The NB/MCH 1025 also connects to the memory 1045 via a memory bus, and connects to the graphics processor 1050 via an accelerated graphics port (AGP). The NB/MCH 1025 also connects to the SB/ICH 1020 via an internal bus (e.g., a unified media interface or a direct media interface). The CPU 1030 can contain one or more processors and even can be implemented using one or more heterogeneous processor systems.

Figure 11:
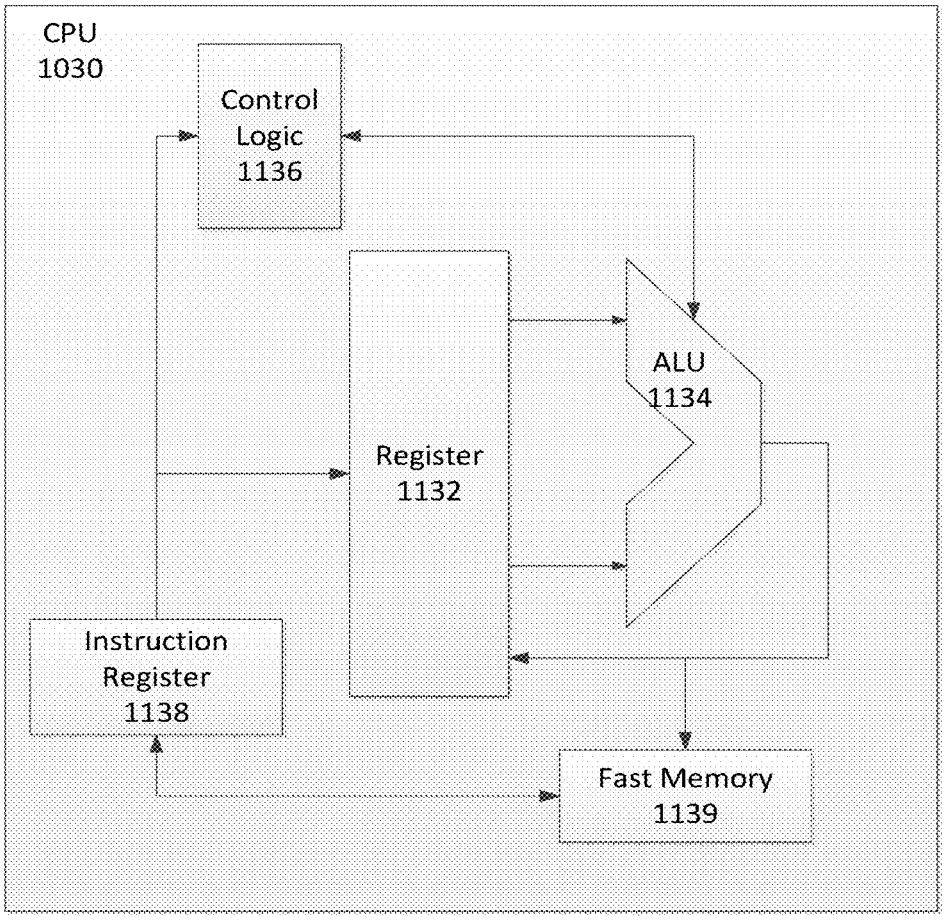
FIG. 11 is a block diagram of an exemplary CPU according to one embodiment.

For example, FIG. 11 illustrates one implementation of CPU 1030. In one implementation, an instruction register 1138 retrieves instructions from a fast memory 1139. At least part of these instructions are fetched from an instruction register 1138 by a control logic 1136 and interpreted according to the instruction set architecture of the CPU 1030. Part of the instructions can also be directed to a register 1132. In one implementation the instructions are decoded according to a hardwired method, and in another implementation the instructions are decoded according to a microprogram that translates instructions into sets of CPU configuration signals that are applied sequentially over multiple clock pulses. After fetching and decoding the instructions, the instructions are executed using an arithmetic logic unit (ALU) 1134 that loads values from the register 1132 and performs logical and mathematical operations on the loaded values according to the instructions. The results from these operations can be fed back into the register 1132 and/or stored in a fast memory 1139. According to aspects of the disclosure, the instruction set architecture of the CPU 1030 can use a reduced instruction set computer (RISC), a complex instruction set computer (CISC), a vector processor architecture, or a very long instruction word (VLIW) architecture. Furthermore, the CPU 1030 can be based on the Von Neuman model or the Harvard model. The CPU 1030 can be a digital signal processor, an FPGA, an ASIC, a PLA, a PLD, or a CPLD. Further, the CPU 1030 can be an x86 processor by Intel or by AMD; an ARM processor; a Power architecture processor by, e.g., IBM; a SPARC architecture processor by Sun Microsystems or by Oracle; or other known CPU architectures.

Referring again to FIG. 10, the data processing system 1000 can include the SB/ICH 1020 being coupled through a system bus to an I/O Bus, a read only memory (ROM) 1056, universal serial bus (USB) port 1064, a flash binary input/output system (BIOS) 1068, and a graphics controller 1058. PCI/PCIe devices can also be coupled to SB/ICH 1020 through a PCI bus 1062.

The PCI devices can include, for example, Ethernet adapters, add-in cards, and PC cards for notebook computers. The Hard disk drive 1060 and CD-ROM 1066 can use, for example, an integrated drive electronics (IDE) or serial advanced technology attachment (SATA) interface. In one implementation the I/O bus can include a super I/O (SIO) device.

Further, the hard disk drive (HDD) 1060 and optical drive 1066 can also be coupled to the SB/ICH 1020 through a system bus. In one implementation, a keyboard 1070, a mouse 1072, a parallel port 1078, and a serial port 1076 can be connected to the system bus through the I/O bus. Other peripherals and devices can be connected to the SB/ICH 1020 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry, or based on the requirements of the intended back-up load to be powered.

The functions and features described herein can also be executed by various distributed components of a system. For example, one or more processors can execute these system functions, wherein the processors are distributed across multiple components communicating in a network. The distributed components can include one or more client and server machines, which can share processing, such as a cloud computing system, in addition to various human interface and communication devices (e.g., display monitors, smart phones, tablets, personal digital assistants (PDAs)). The network can be a private network, such as a LAN or WAN, or can be a public network, such as the Internet. Input to the system can be received via direct user input and received remotely either in real-time or as a batch process. Additionally, some implementations can be performed on modules or hardware not identical to those described. Accordingly, other implementations are within the scope that can be claimed.

The functions and features described herein may also be executed by various distributed components of a system. For example, one or more processors may execute these system functions, wherein the processors are distributed across multiple components communicating in a network. For example, distributed performance of the processing functions can be realized using grid computing or cloud computing. Many modalities of remote and distributed computing can be referred to under the umbrella of cloud computing, including: software as a service, platform as a service, data as a service, and infrastructure as a service. Cloud computing generally refers to processing performed at centralized locations and accessible to multiple users who interact with the centralized processing locations through individual terminals.

Figure 12:
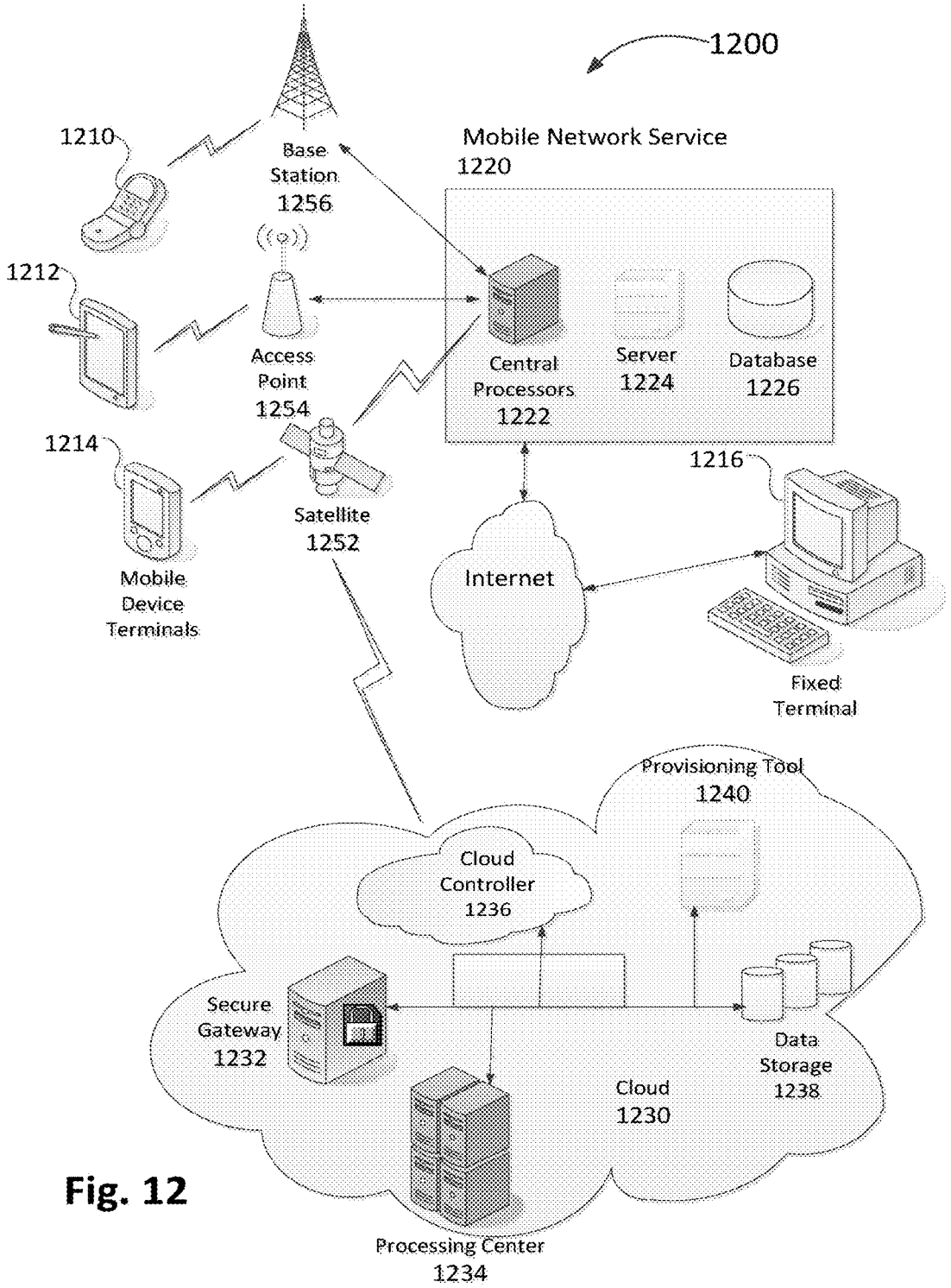
FIG. 12 illustrates an exemplary cloud computing system according to one embodiment.

FIG. 12 illustrates an exemplary cloud computing system 1200, wherein users access the cloud through mobile device terminals or fixed terminals that are connected to the Internet. One or more of devices illustrated as server 110 can be used in the cloud computing system 1200 illustrated in FIG. 12.

The mobile device terminals can include a cell phone 1210, a tablet computer 1212, and a smartphone 1214, for example. The mobile device terminals can connect to a mobile network service 1220 through a wireless channel such as a base station 1256 (e.g., an Edge, 3G, 4G, or LTE Network), an access point 1254 (e.g., a femto cell or WiFi network), or a satellite connection 1252. In one implementation, signals from the wireless interface to the mobile device terminals (e.g., the base station 1256, the access point 1254, and the satellite connection 1252) are transmitted to a mobile network service 1220, such as an EnodeB and radio network controller, UNITS, or HSDPA/HSUPA. Mobile users' requests and information are transmitted to central processors 1222 that are connected to servers 1224 to provide mobile network services, for example. Further, mobile network operators can provide service to mobile users for authentication, authorization, and accounting based on home agent and subscribers' data stored in databases 1226, for example. The subscribers' requests are subsequently delivered to a cloud 1230 through the Internet.

A user can also access the cloud 1230 through a fixed terminal 1216, such as a desktop or laptop computer or workstation that is connected to the Internet via a wired network connection or a wireless network connection. The mobile network service 1220 can be a public or a private network such as an LAN or WAN network. The mobile network service 1220 can be wireless such as a cellular network including EDGE, 3G and 4G wireless cellular systems. The wireless mobile network service 1220 can also be Wi-Fi, Bluetooth, or any other wireless form of communication that is known.

The user's terminal, such as a mobile user terminal and a fixed user terminal, provides a mechanism to connect via the Internet to the cloud 1230 and to receive output from the cloud 1230, which is communicated and displayed at the user's terminal. In the cloud 1230, a cloud controller 1236 processes the request to provide users with the corresponding cloud services. These services are provided using the concepts of utility computing, virtualization, and service-oriented architecture.

In one implementation, the cloud 1230 is accessed via a user interface such as a secure gateway 1232. The secure gateway 1232 can for example, provide security policy enforcement points placed between cloud service consumers and cloud service providers to interject enterprise security policies as the cloud-based resources are accessed. Further, the secure gateway 1232 can consolidate multiple types of security policy enforcement, including for example, authentication, single sign-on, authorization, security token mapping, encryption, tokenization, logging, alerting, and API control.

The cloud 1230 can provide to users, computational resources using a system of virtualization, wherein processing and memory requirements can be dynamically allocated and dispersed among a combination of processors and memories to create a virtual machine that is more efficient at utilizing available resources. Virtualization creates an appearance of using a single seamless computer, even though multiple computational resources and memories can be utilized according to increases or decreases in demand. In one implementation, virtualization is achieved using a provisioning tool 1240 that prepares and equips the cloud resources, such as the processing center 1234 and data storage 1238 to provide services to the users of the cloud 1230. The processing center 1234 can be a computer cluster, a data center, a main frame computer, or a server farm. In one implementation, the processing center 1234 and data storage 1238 are collocated.

Embodiments described herein can be implemented with one or more of the devices described above with reference to FIGS. 9-11 and/or in conjunction with the cloud computing system 1200 of FIG. 12. Embodiments are a combination of hardware and software, and processing circuitry by which the software is implemented.

FIG. 13 illustrates an exemplary flowchart for a traffic movement method 1300 according to an aspect of the present disclosure. Method 1300 includes programmable computer-executable instructions, that when used in combination with the above-described hardware devices, carry out the steps of method 1300. The hardware description above, exemplified by any one of the structural examples illustrated in FIGS. 9-11 constitutes or includes specialized corresponding structure that is programmed or configured to perform the algorithm illustrated in FIG. 13. For example, the algorithm illustrated in FIG. 13 can be completely performed by the single device illustrated in FIG. 9 or by the chipset illustrated in FIGS. 10 and 11. In addition, the algorithm illustrated in FIG. 13 can be executed in conjunction with the cloud computing system 1200 illustrated in FIG. 12.

FIG. 13 is a flowchart for an exemplary traffic movement method 1300. Method 1300 can be implemented using one or more of the computing systems 900 or 1000 and/or the cloud computing system 1200 described herein.

In step S1310, method 1300 includes transmitting a first signal, via processing circuitry of a communications server, to a first traffic movement surface indicator positioned behind an edge of a vehicle traffic intersection when a first monitored event occurs. A vehicle intersection traffic movement indicator is configured to regulate forward movement of vehicle traffic through the vehicle traffic intersection. The first monitored event includes one of a) a first vehicle approaching towards the first traffic movement surface indicator, b) an end of a first timed interval, or c) a second vehicle approaching towards or stopped at a second traffic movement surface indicator prior to the first vehicle approaching towards the first traffic movement surface indicator, the second vehicle being perpendicular with respect to the first vehicle.

In step S1320, method 1300 includes transmitting a second signal, via processing circuitry of the communications server, to a first right-turn traffic direction surface indicator directing the first vehicle to turn right from a first street to a second street when a second monitored event occurs. The second monitored event includes one of a) a start of a second timed interval, or b) non-activation of a third traffic movement surface indicator for a third vehicle approaching the vehicle traffic intersection while driving on the second street in a same direction as the first vehicle after turning onto the second street, and non-activation of a first left-turn traffic direction surface indicator for a fourth vehicle turning left into the vehicle traffic intersection from the first street to the second street.

In step S1330, method 1300 includes transmitting a third signal, via processing circuitry of the communications server, to a second left-turn traffic direction surface indicator directing the first vehicle to turn left from the first street to the second street when a third monitored event occurs. The third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first vehicle after turning onto the second street.

In step S1340, method 1300 includes transmitting a fourth signal, via processing circuitry of the communications server, to a pedestrian lane surface indicator when a fourth monitored event occurs. The fourth monitored event includes one of a) a manual activation of the pedestrian lane surface indicator, or b) activation of an adjacent traffic movement surface indicator to the pedestrian lane surface indicator.

Embodiments described herein provide several technical advantages. A vehicle traffic intersection can be monitored, via sensors and processing circuitry of a communications server to provide safer and smoother flow of traffic around and through the vehicle traffic intersection. Traffic activity is monitored for each of forward movement, right-turn movement, left-turn movement, and pedestrian movement through the vehicle traffic intersection. Monitored traffic activity according to embodiments described herein especially provides safer and smoother traffic flow during times of low visibility due to rain, snow, fog, and nighttime, and during congested times.

Embodiments described herein also provide a major technical advantage for driverless vehicles. Since traffic activity is monitored for each of forward movement, right-turn movement, left-turn movement, and pedestrian movement through the vehicle traffic intersection, safe and smooth traffic flow can be provided, even in the absence of drivers.

Embodiments described herein include the following aspects.

(1) An intersection communications system includes a vehicle intersection traffic movement indicator configured to regulate forward movement of a vehicle through a vehicle traffic intersection and positioned within or adjacent to the vehicle traffic intersection; a traffic movement surface indicator positioned behind an edge of the vehicle traffic intersection; a pedestrian lane surface indicator positioned adjacent to the edge of the vehicle traffic intersection; one or more traffic direction surface indicators positioned within the vehicle traffic intersection; and a communications server having processing circuitry. The processing circuitry is configured to transmit a first signal to a first traffic movement surface indicator when a first monitored event occurs, wherein the first monitored event includes one of a) a first vehicle approaching towards the first traffic movement surface indicator, b) an end of a first timed interval, or c) a second vehicle approaching towards or stopped at a second traffic movement surface indicator prior to the first vehicle approaching towards the first traffic movement surface indicator, the second vehicle being perpendicular with respect to the first vehicle; transmit a second signal to a first right-turn traffic direction surface indicator directing the first vehicle to turn right from a first street to a second street when a second monitored event occurs, wherein the second monitored event includes one of a) a start of a second timed interval, or b) non-activation of a third traffic movement surface indicator for a third vehicle approaching the vehicle traffic intersection while driving on the second street in a same direction as the first vehicle after turning onto the second street, and non-activation of a first left-turn traffic direction surface indicator for a fourth vehicle turning left into the vehicle traffic intersection from the first street to the second street; transmit a third signal to a second left-turn traffic direction surface indicator directing the first vehicle to turn left from the first street to the second street when a third monitored event occurs, wherein the third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first vehicle after turning onto the second street; and transmit a fourth signal to the pedestrian lane surface indicator when a fourth monitored event occurs, wherein the fourth monitored event includes one of a) a manual activation of the pedestrian lane surface indicator, or b) activation of an adjacent traffic movement surface indicator to the pedestrian lane surface indicator.

(2) The intersection communications system of (1), wherein the vehicle intersection traffic movement indicator includes one of a vehicle traffic signal, a stop sign, a flashing stop sign, or a flashing stop indicator of the vehicle traffic signal.

(3) The intersection communications system of either (1) or (2), wherein any one of the vehicle intersection traffic movement indicator, the one or more traffic movement surface indicators, the pedestrian lane surface indicator, or the one or more traffic direction surface indicators are activated according to real-time traffic conditions, via the processing circuitry of the communications server communicating with a real-time local traffic advisory source.

(4) The intersection communications system of any one of (1) through (3), wherein any one of the vehicle intersection traffic movement indicator, the one or more traffic movement surface indicators, the pedestrian lane surface indicator, or the one or more traffic direction surface indicators are controlled according to a programmed path of an oncoming authorized vehicle programmed via the processing circuitry of the communications server.

(5) The intersection communications system of any one of (1) through (4), wherein, when a low traffic visibility is present within the vehicle traffic intersection, an intensity of illumination of any one of the vehicle intersection traffic movement indicator, the one or more traffic movement surface indicators, the pedestrian lane surface indicator, or the one or more traffic direction surface indicators is increased according to local weather advisory data processed by the processing circuitry of the communications server.

(6) The intersection communications system of any one of (1) through (5), wherein each of the vehicle intersection traffic movement indicator, the one or more traffic movement surface indicators, the pedestrian lane surface indicator, and the one or more traffic direction surface indicators includes a plurality of interconnected light emitting diodes (LEDs).

(7) The intersection communications system of any one of (1) through (6), wherein activation of any one of the vehicle intersection traffic movement indicator, the one or more traffic movement surface indicators, the pedestrian lane surface indicator, or the one or more traffic direction surface indicators includes a constant illumination, a flashing illumination, or a streaming illumination of the interconnected LEDs.

(8) The intersection communications system of any one of (1) through (7), wherein each of the vehicle intersection traffic movement indicator, the one or more traffic movement surface indicators, the pedestrian lane surface indicator, and the one or more traffic direction surface indicators includes a wireless signal transceiver in communication with the communications server.

(9) The intersection communications system of any one of (1) through (8), wherein the processing circuitry is further configured to transmit an auditory signal during activation of any of the vehicle intersection traffic movement indicator, the one or more traffic movement surface indicators, the pedestrian lane surface indicator, or the one or more traffic direction surface indicators.

(10) The intersection communications system of any one of (1) through (9), wherein the first timed interval, the second timed interval, and the third timed interval coincide with an associated positive vehicle traffic movement indicator of a vehicle traffic signal.

(11) The intersection communications system of any one of (1) through (10), wherein one or more of the left-turn traffic direction surface indicators is a dual-purpose traffic direction surface indicator which also includes a second right-turn traffic direction surface indicator.

(12) The intersection communications system of any one of (1) through (11), wherein the first monitored event occurs via activation of one or more motion sensors or pressure sensors.

(13) The intersection communications system of any one of (1) through (12), wherein the second monitored event occurs via non-activation of a plurality of traffic movement surface indicators.

(14) The intersection communications system of any one of (1) through (13), wherein the third monitored event occurs via non-activation of a combination of one or more traffic movement surface indicators and one or more traffic direction surface indicators.

(15) A traffic movement method includes transmitting a first signal, via processing circuitry of a communications server, to a first traffic movement surface indicator positioned behind an edge of a vehicle traffic intersection when a first monitored event occurs, wherein a vehicle intersection traffic movement indicator is configured to regulate forward movement of vehicle traffic through the vehicle traffic intersection, and wherein the first monitored event includes one of a) a first vehicle approaching towards the first traffic movement surface indicator, b) an end of a first timed interval, or c) a second vehicle approaching towards or stopped at a second traffic movement surface indicator prior to the first vehicle approaching towards the first traffic movement surface indicator, the second vehicle being perpendicular with respect to the first vehicle; transmitting a second signal, via processing circuitry of the communications server, to a first right-turn traffic direction surface indicator directing the first vehicle to turn right from a first street to a second street when a second monitored event occurs, wherein the second monitored event includes one of a) a start of a second timed interval, or b) non-activation of a third traffic movement surface indicator for a third vehicle approaching the vehicle traffic intersection while driving on the second street in a same direction as the first vehicle after turning onto the second street, and non-activation of a first left-turn traffic direction surface indicator for a fourth vehicle turning left into the vehicle traffic intersection from the first street to the second street; transmitting a third signal, via processing circuitry of the communications server, to a second left-turn traffic direction surface indicator directing the first vehicle to turn left from the first street to the second street when a third monitored event occurs, wherein the third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first vehicle after turning onto the second street; and transmitting a fourth signal, via processing circuitry of the communications server, to a pedestrian lane surface indicator when a fourth monitored event occurs, wherein the fourth monitored event includes one of a) a manual activation of the pedestrian lane surface indicator, or b) activation of an adjacent traffic movement surface indicator to the pedestrian lane surface indicator.

(16) The traffic movement method of (15), further includes activating any of the vehicle intersection traffic movement indicator, the one or more traffic movement surface indicators, the pedestrian lane surface indicator, or the one or more traffic direction surface indicators according to real-time traffic conditions, via the processing circuitry of the communications server communicating with a real-time local traffic advisory source.

(17) The traffic movement method of either (15) or (16), further includes when a low traffic visibility is present within the vehicle traffic intersection, increasing an intensity of illumination of any one of the vehicle intersection traffic movement indicator, the one or more traffic movement surface indicators, the pedestrian lane surface indicator, or the one or more traffic direction surface indicators according to local weather advisory data processed by the processing circuitry of the communications server.

(18) The traffic movement method of any one of (15) through (17), wherein each of the vehicle intersection traffic movement indicator, the one or more traffic movement surface indicators, the pedestrian lane surface indicator, and the one or more traffic direction surface indicators includes a wireless signal transceiver in communication with the communications server.

(19) The traffic movement method of any one of (15) through (18), wherein one or more of the left-turn traffic direction surface indicators is a dual-purpose traffic direction surface indicator which also includes a second right-turn traffic direction surface indicator.

(20) The traffic movement method of any one of (15) through (19), wherein the first monitored event occurs via activation of one or more motion sensors or pressure sensors.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components. The functions, processes, and algorithms described herein may be performed in hardware or software executed by hardware, including computer processors and/or programmable circuits configured to execute program code and/or computer instructions to execute the functions, processes, and algorithms described herein. Additionally, an implementation may be performed on modules or hardware not identical to those described. Accordingly, other implementations are within the scope that may be claimed.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. An intersection communications system, comprising:

a vehicle intersection traffic movement indicator configured to regulate forward movement of a vehicle through a vehicle traffic intersection and positioned within or adjacent to the vehicle traffic intersection;

a traffic movement surface indicator positioned behind an edge of the vehicle traffic intersection;

a pedestrian lane surface indicator positioned adjacent to the edge of the vehicle traffic intersection;

one or more traffic direction surface indicators positioned within the vehicle traffic intersection, wherein each of the traffic movement surface indicator, the pedestrian lane surface indicator, and the one or more traffic direction surface indicators includes a plurality of interconnected electronic signal-receiving devices; and a communications server having processing circuitry configured to transmit a first signal to a first traffic movement surface indicator and to a first driverless vehicle when a first monitored event occurs, wherein the first monitored event includes one of a) the first driverless vehicle approaching towards the first traffic movement surface indicator, b) an end of a first timed interval, or c) a second vehicle approaching towards or stopped at a second traffic movement surface indicator prior to the first driverless vehicle approaching towards the first traffic movement surface indicator, the second vehicle being perpendicular with respect to the first driverless vehicle, transmit a second signal to a first right-turn traffic direction surface indicator and to the first driverless vehicle directing the first driverless vehicle to turn right from a first street to a second street when a second monitored event occurs, wherein the second monitored event includes one of a) a start, of a second timed interval, or b) non-activation of a third traffic movement surface indicator for a third vehicle approaching the vehicle traffic intersection while driving on the second street in a same direction as the first driverless vehicle after turning onto the second street, and non-activation of a first left-turn traffic direction surface indicator for a fourth vehicle turning left into the vehicle traffic intersection from the first street to the second street, transmit a third signal to a second left-turn traffic direction surface indicator and to the first driverless vehicle directing the first driverless vehicle to turn left from the first street to the second street then a third monitored event occurs, wherein the third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first driverless vehicle after turning onto the second street, and transmit a fourth signal to the pedestrian lane surface indicator when a fourth monitored event occurs, wherein the fourth monitored event includes one of a) a manual activation of the pedestrian lane surface indicator, or b) activation of an adjacent traffic movement surface indicator to the pedestrian lane surface indicator.

2. The intersection communications system of claim 1, wherein the vehicle intersection traffic movement indicator includes one of a vehicle traffic signal, a stop sign, a flashing stop sign, or a flashing stop indicator of the vehicle traffic signal.

3. The intersection communications system of claim 2, wherein any one of the vehicle intersection traffic movement indicator, the traffic movement surface indicator, the pedestrian lane surface indicator, or the one or more traffic direction surface indicators are activated according to real-time traffic conditions, via the processing circuitry of the communications server communicating with a real-time local traffic advisory source.

4. The intersection communications system of claim 2, wherein any one, of the vehicle intersection traffic movement indicator, the traffic movement surface indicators, the pedestrian lane surface indicator, or the one or more traffic direction surface indicators are controlled according to a programmed path of an oncoming authorized vehicle programmed via the processing circuitry of the communications server.

5. The intersection communications system of claim 2, wherein, when a low traffic visibility is present within, the vehicle traffic intersection, an intensity of illumination of any one of the vehicle intersection traffic movement indicator, the traffic movement surface indicators, the pedestrian lane surface indicator, or the one or more traffic direction surface indicators is increased according to local weather advisory data processed by the processing circuitry of the communications server.

6. The intersection communications system of claim 1, wherein each of the vehicle intersection traffic movement indicator, the traffic movement surface indicators, the pedestrian lane surface indicator, and the one or more traffic direction, surface indicators includes a plurality of interconnected light emitting diodes (LEDs).

7. The intersection communications system of claim 6, wherein activation of any one of the vehicle intersection traffic movement indicator, the traffic movement surface indicators, the pedestrian lane surface indicator, or the one or more traffic direction surface indicators includes a constant illumination, a flashing illumination, or a streaming illumination of the interconnected LEDs.

8. The intersection communications system of claim 6, wherein each of the vehicle intersection traffic movement indicator, the traffic movement surface indicator, the pedestrian lane surface indicator, and the one or more traffic direction surface indicators includes a wireless signal transceiver in communication with the communications server.

9. The intersection communications system of claim 1, wherein the processing circuitry is further configured to transmit an auditory signal during activation of any of the vehicle intersection traffic movement indicator, the traffic movement surface indicator, the pedestrian lane surface indicator, or the one or more traffic direction surface indicators.

10. The intersection communications system of claim 1, wherein the first timed interval, the second timed interval, and the third limed interval coincide with an associated positive vehicle traffic movement indicator of a vehicle traffic signal.

11. The intersection communications system of claim 1, wherein one or more of the left-turn traffic direction surface indicators is a dual-purpose traffic direction surface indicator which also includes a second right-turn traffic direction surface indicator.

12. The intersection communications system of claim 1, wherein the first monitored event occurs via activation of one or more motion sensors or pressure sensors.

13. The intersection communications system of claim 1, wherein the second monitored event occurs via non-activation of a plurality of traffic movement surface indicators.

14. The intersection communications system of claim 1, wherein the third monitored event occurs via non-activation of a combination of one or more traffic movement surface indicators and one or more traffic direction surface indicators.

15. A traffic movement method, comprising:

transmitting a first signal, via processing circuitry of a communications server, to a first traffic movement surface indicator and to a first driverless vehicle positioned behind an edge of a vehicle traffic intersection when a first monitored event occurs, wherein a vehicle intersection traffic movement indicator is configured to regulate forward movement of vehicle traffic through the vehicle traffic intersection, and wherein the first monitored event includes one of a) the first driverless vehicle approaching towards the first traffic movement surface indicator, b) an end of a first timed interval, or c) a second vehicle approaching towards or stopped at a second traffic movement surface indicator prior to the first driverless vehicle approaching towards the first traffic movement surface indicator, the second vehicle being perpendicular with respect to the first driverless vehicle;

transmitting a second signal, via the processing, circuitry of the communications server, to a first right-turn traffic direction surface indicator directing the first driverless vehicle to turn right from a first street to a second street when a second monitored event occurs, wherein the second monitored event includes one of a) a start of a second timed interval, or b) non-activation of a third traffic movement surface indicator for a third vehicle approaching the vehicle traffic intersection while driving on the second street in a same direction as the first driverless vehicle after turning onto the second street, and non-activation of a first left-turn traffic direction surface indicator for a fourth vehicle turning left into the vehicle traffic intersection from the first street to the second street;

transmitting a third signal, via the processing circuitry of the communications server, to a second left-turn traffic direction surface indicator directing the first driverless vehicle to turn left from the first street to the second street when a third monitored event occurs, wherein the third monitored event includes one of a) a start of a third timed interval, or b) non-activation of an associated traffic movement surface indicator for a fifth vehicle approaching the vehicle traffic intersection from either direction on the second street, and non-activation of a second right-turn traffic direction surface indicator for a sixth vehicle turning right into the vehicle traffic intersection from the first street to the second street in a same direction as the first driverless vehicle after turning onto the second street; and transmitting a fourth signal, via the processing circuitry of the communications server, to a pedestrian lane surface indicator when a fourth monitored event occurs, wherein the fourth monitored event includes one of a) a manual activation of the pedestrian lane surface indicator, or b) activation of an adjacent traffic movement surface indicator to the pedestrian lane surface indicator, wherein each of the first, second, and third traffic movement surface indicators, the pedestrian lane surface indicator, the first and second right-turn direction surface indicators, and the first and second left-turn direction surface indicators includes a plurality of interconnected electronic signal-receiving devices.

16. The traffic movement method of claim 15, further comprising:

activating any of the vehicle intersection traffic movement indicator, the first, second, or third traffic movement surface indicators, the pedestrian lane surface indicator, the first or second right-turn direction surface indicators, or the first or second left-turn direction surface indicators according to real-time traffic conditions, via the processing circuitry of the communications server communicating with a real-time local traffic advisory source.

17. The traffic movement method of claim 16, further comprising:

when a low traffic visibility is present within the vehicle traffic intersection, increasing an intensity of illumination of any one of the vehicle intersection traffic movement indicator, the first, second, or third traffic movement surface indicators, the pedestrian lane surface indicator, the first or second right-turn direction surface indicators, or the first or second left-turn direction surface indicators according to local weather advisory data processed by the processing circuitry of the communications server.

18. The traffic movement method of claim 17, wherein each of the vehicle intersection traffic movement indicator, the first, second, or third traffic movement surface indicators, the pedestrian lane surface indicator, the first or second right-turn direction surface indicators, and the first or second left-turn direction surface indicators includes a wireless signal transceiver in communication with the communications server.

19. The traffic movement method of claim 15, wherein one or more of the first and second left-turn traffic direction surface indicators is a dual-purpose traffic direction surface indicator which also includes a third right-turn traffic direction surface indicator.

20. The traffic movement method of claim 15, wherein the first monitored event occurs via activation of one or more motion sensors or pressure sensors.

* * * * *